US012202646B2

(12) United States Patent
Neal et al.

(10) Patent No.: US 12,202,646 B2
(45) Date of Patent: Jan. 21, 2025

(54) RELEASE LINER FOR MAILER PACKAGES

(71) Applicant: PAC WORLDWIDE CORPORATION, Redmond, WA (US)

(72) Inventors: Paul Matthew Neal, Fairfield, OH (US); Murray Fullerton, Papakura (NZ); Brian Andrew Kendall, Maineville, OH (US); Paul Andrew Frederick, Harrison, OH (US); Leslie Nicholas Rogers, Jr., Liberty Township, OH (US)

(73) Assignee: PAC Worldwide Corporation, Redmond, WA (US)

( * ) Notice: Subject to any disclaimer, the term of this patent is extended or adjusted under 35 U.S.C. 154(b) by 0 days.

(21) Appl. No.: 17/899,468

(22) Filed: Aug. 30, 2022

(65) Prior Publication Data

US 2023/0066112 A1 Mar. 2, 2023

Related U.S. Application Data

(60) Provisional application No. 63/319,740, filed on Mar. 14, 2022, provisional application No. 63/240,336, filed on Sep. 2, 2021.

(51) Int. Cl.
*B65D 27/10* (2006.01)
*B65D 27/14* (2006.01)

(52) U.S. Cl.
CPC ..... *B65D 27/10* (2013.01); *B65D 27/14* (2013.01)

(58) Field of Classification Search
CPC ..... B65D 27/10; B65D 27/14
See application file for complete search history.

(56) References Cited

U.S. PATENT DOCUMENTS 3,273,784 A * 9/1966 Porter ..... B65D 27/10 229/69
3,456,869 A * 7/1969 Paulson ..... B65D 27/10 229/69
3,554,447 A * 1/1971 Sebring ..... B65D 27/10 229/80

(Continued)

FOREIGN PATENT DOCUMENTS

DE 102017102092 * 8/2018
WO WO 03062076 A1 7/2003
WO WO 2012154943 A2 11/2012

*Primary Examiner* — Derek J Battisti
(74) *Attorney, Agent, or Firm* — Seed IP Law Group LLP

(57) ABSTRACT

The present disclosure is directed to one or more embodiments of mailer package assemblies including a fixed release liner and a mailer package. The fixed release liner is removably or detachably coupled to the mailer package by an adhesive layer. The fixed release liner includes one or more wickets (e.g., openings) such that the fixed release liner may be mounted to a wall by inserting fasteners (e.g., tack(s), pin(s), etc.) into the openings. The mailer package may be removed, detached, or decoupled from the fixed release liner by pulling on the mailer package decoupling the fixed release liner from the mailer package. After the mailer package is removed, an packaging associate may place an item or product within the mailer package to be shipped to a consumer. After the mailer package is removed from the fixed release liner, the fixed release liner remains mounted to the wall.

10 Claims, 19 Drawing Sheets

(56) References Cited

U.S. PATENT DOCUMENTS

| | | | | |
|---|---|---|---|---|
| 3,980,006 | A * | 9/1976 | Welch | B65D 27/10 229/69 |
| 4,091,987 | A * | 5/1978 | Cone | B65D 27/10 229/69 |
| 4,759,643 | A | 7/1988 | Canno | |
| 5,014,852 | A | 5/1991 | Herrington et al. | |
| 5,575,393 | A | 11/1996 | Gebhardt | |
| 7,100,348 | B2 * | 9/2006 | Mertens | B65D 27/10 493/917 |
| 2002/0011304 | A1 | 1/2002 | Abron | |
| 2002/0112452 | A1 | 8/2002 | DeSmedt | |
| 2005/0184140 | A1 | 8/2005 | DeLa Vergne | |
| 2009/0229717 | A1 | 9/2009 | Halseth et al. | |
| 2022/0135309 | A1 * | 5/2022 | Wetsch | B65D 65/40 206/523 |

* cited by examiner

RELEASE LINER FOR MAILER PACKAGES

BACKGROUND

Technical Field

The present disclosure is directed to stacked packaging systems including release liners coupled together and coupled to mailer packages.

Description of the Related Art

Generally, mailer packages are utilized to mail products, items, or some other type of objects to a consumer that has purchased them either through an online website (e.g., online portal), over the telephone, or by some other type of remote communication. These mailer packages generally have a release liner that covers an adhesive layer on a closure flap of the mailer package. The release liner is removed by an employee (e.g., user, packager, packing associate, etc.) to expose the adhesive layer on the closure flap. The release liner is generally removed by peeling off the release liner from the adhesive layer. By removing the release liner from the closure flap, the release liner is completely separated from the mailer package and is thrown into a disposal receptacle (e.g., trash can, waste can, etc.). The employee then places the product or item within a cavity of the mailer package, folds the closure flap towards an outer surface of the mailer package, and seals the cavity of the mailer package by pressing the adhesive layer onto the outer surface adhering the closure flap to the outer surface sealing off the cavity within the mailer package. These release liners covering the adhesive layer are generally metallized.

BRIEF SUMMARY

The present disclosure is directed to embodiments of mailer packages each including a fixed release liner removably coupled to an end of the mailer package. The fixed release liner includes a flap removably coupled to the end of the mailer package by an adhesive layer. The flap is removably coupled to a closure flap of the mailer package by the adhesive layer such that the mailer package may be removed from the fixed release liner by pulling on the mailer package removing the closure flap from the flap of the fixed release liner.

One or more of the fixed release liners may be coupled together such that one or more mailer packages are indirectly coupled together as well. For example, the one or more release liners may be coupled together by one or more fasteners (e.g., staple, pronged fastener, etc.). Each one of the one or more mailer packages is coupled to a corresponding one of the flaps of the one or more fixed release liners by one or more adhesive layers. The one or more mailer packages may then be removed from the one or more fixed release liner includes by pulling on the one or more mailer packages individually to remove the one or more mailer packages one by one from a corresponding one of the fixed release liners of which are all coupled together by one or more fasteners. For example, a packaging employee removes one of the mailer packages from one of the fixed release liner by pulling on the mailer package removing the mailer package from the flap of the fixed release liner by applying enough force to overcome the adhesive layer coupling the mailer package to the flap of the fixed release liner. Removing the mailer package results in the adhesive layer remaining on the closure flap of the mailer package and exposes the adhesive layer on the closure flap. The adhesive layer exposed on the closure flap may then be utilized to seal a cavity of the mailer package by adhering the closure flap to a region of an outer surface of the mailer package utilizing the adhesive layer.

In some embodiments, the fixed release liners may be physically coupled directly to the closure flap of tear away portions that are between perforations. Each one of the tear away portions may be between adjacent ones of the perforations. When a packaging employee pulls on the mailer package, the tear away portions between the perforations are torn resulting in the mailer package being removed from the corresponding one of the fixed release liners.

In some embodiments, the fixed release liners may include one or more wickets or openings that extend through the fixed release liners such that the fixed release liners may be fixed or stationarily mounted to an external surface (e.g., a wall, a table, etc.) by placing a fastener through the one or more wickets or openings fixing or stationarily mounting the fixed release liners to the wall. As the packaging employee removes the one or more mailer packages from the fixed release liners, the flaps remain coupled to the wall. As the fixed release liners are coupled together by one or more fasteners or, in some embodiments, by welds, the fixed release liners will remain together and together will be heavier together than alone individually.

BRIEF DESCRIPTION OF THE SEVERAL VIEWS OF THE DRAWINGS

For a better understanding of the embodiments, reference will now be made by way of example to the accompanying drawings. In the drawings, identical reference numbers identify the same or similar elements or acts unless the context indicates otherwise. The sizes and relative proportions of the elements in the drawings are not necessarily drawn to scale. For example, some of these elements may be enlarged and positioned to improve drawing legibility.

DETAILED DESCRIPTION

Figure 1A:
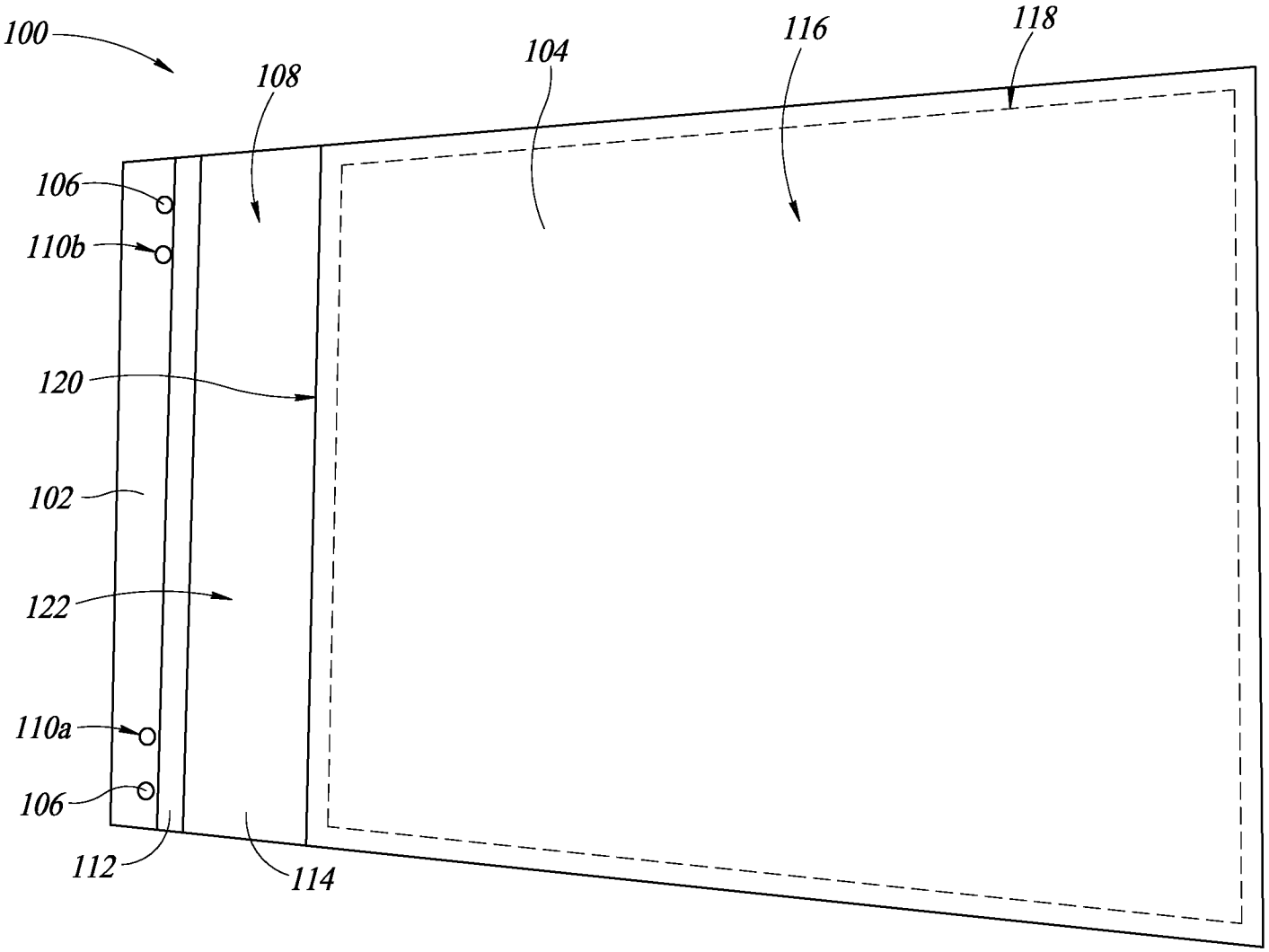
FIG. 1A is a top plan view of an embodiment of a fixed release liner structure of the present disclosure coupled to one or more mailer packages.

In the following description, certain specific details are set forth in order to provide a thorough understanding of various embodiments of the disclosure. However, one skilled in the art will understand that the disclosure may be practiced without these specific details. In other instances, well-known structures associated with mailer packages and packaging methods have not been described in detail to avoid unnecessarily obscuring the descriptions of the embodiments of the present disclosure.

Unless the context requires otherwise, throughout the specification and claims that follow, the word "comprise" and variations thereof, such as "comprises" and "comprising," are to be construed in an open, inclusive sense, that is, as "including, but not limited to."

The use of ordinals such as first, second, third, etc., does not necessarily imply a ranked sense of order, but rather may only distinguish between multiple instances of an act or a similar structure or material.

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The terms "left," "right," "top," "bottom," "upper," or "lower" are used for only discussion purposes based on the orientation of the components in the discussion of the Figures in the present disclosure as follows. These terms are not limiting as the possible positions explicitly disclosed, implicitly disclosed, or inherently disclosed in the present disclosure.

As used in this specification and the appended claims, the singular forms "a," "an," and "the" include plural referents unless the content clearly dictates otherwise.

While various embodiments are shown and described with respect to fixed release liners coupled to one or more mailer packages, it will be readily appreciated that embodiments of the present disclosure are not limited thereto. In various embodiments, the structures, devices, methods and the like described herein may be embodied in or otherwise utilized in any suitable type or form of a fixed release liner coupled to one or more mailer packages.

The present disclosure is directed to embodiments of mailer packages that are removably coupled to a fixed release liner at an end of the mailer package. In at least one embodiment, the fixed release liner includes a flap removably coupled to the end of the mailer package by an adhesive layer. The flap is removably coupled to a closure flap of the mailer package by the adhesive layer such that the mailer package may be removed from the fixed release liner by pulling on the mailer package removing the closure flap from the flap of the fixed release liner.

One or more of the fixed release liners may be coupled together such that one or more mailer packages are indirectly coupled together as well. For example, the one or more release liners may be coupled together by one or more fasteners (e.g., staple), and the fixed release liners that are coupled together may position the one or more mailer packages in a stacked configuration. Each one of the one or more mailer packages is coupled to a corresponding one of the flaps of the one or more fixed release liners by one or more adhesive layers. The one or more mailer packages may then be removed from the one or more fixed release liner includes by pulling on the one or more mailer packages individually to remove the one or more mailer packages one by one from a corresponding one of the fixed release liners of which are all coupled together by one or more fasteners. The coupled together fixed release liners may be a fixed release liner structure. For example, a packaging employee removes one of the mailer packages from one of the fixed release liners by pulling on the mailer package removing the mailer package from the flap of the fixed release liner by applying enough force to overcome the adhesive layer coupling the mailer package to the flap of the fixed release liner. Removing the mailer package results in the adhesive layer remaining on the closure flap of the mailer package and exposes the adhesive layer on the closure flap. The adhesive layer exposed on the closure flap may then be utilized to seal a cavity of the mailer package by adhering the closure flap to a region of an outer surface of the mailer package utilizing the adhesive layer.

The fixed release liners may include one or more wickets or openings that extend through the fixed release liners such that the fixed release liners may be fixed to a wall by placing a fastener through the one or more wickets or openings fixing the fixed release liner to the wall. As the packaging employee removes the one or more mailing packages from the fixed release liners, the flaps remain coupled to the wall. As the fixed release liners are coupled together by one or more fasteners or by welds (e.g., heat, laser, adhesive, etc.), the fixed release liners will remain together and together will be heavier together than alone individually.

Generally, conventional mailer packages are each kept separate and distinct from each other such that a packaging employee picks up one of the conventional mailer packages, orients the conventional mailer package, inserts a product or item to be shipped to a purchaser into a cavity in the conventional mailer package, grasps a release liner covering an adhesive layer on a closure flap of the respective conventional mailer package, removes the release liner to expose the adhesive layer, and folds the closure flap to adhere the closure flap to an external surface of the conventional mailer package utilizing the adhesive layer previously covered by the release liner. The release liner is then disposed into a trash or waste receptacle individually and alone. The release liners are relatively lightweight such that the release liners may be blown away by a slight wind or gust when placed within the trash or waste receptacle causing environmental pollution. The above process may also increase a speed at which a packaging employee may package a product or item as the packaging employee may not need to spend extra time worrying about an orientation of the mailer package when packaging the product or item as the mailer package will already be in the optimal orientation when utilized by the packaging employee.

The present disclosure is directed to embodiments of stacked packaging systems in which multiple release liners are kept together reducing the likelihood of pollution entering the environment as compared to utilizing and disposing of the individual and separate release liners of the conventional mailer packages as discussed above. Keeping multiple ones of the fixed release liners together as in the embodiments of the present disclosure results in the multiple ones of the fixed release liners coupled together being heavier than those individual and separate ones of the release liners that are thrown in the trash or waste receptacle individually when utilizing the conventional mailer packages. The heavier weight of the fixed release liners being coupled together reduces the likelihood of the fixed release liners blowing out of or exiting the commercial trash or waste receptacle. This reduces the likelihood or prevents the fixed release liners from entering the environment as pollution, which may be potentially harmful to the environment such as surrounding habitats and wildlife.

Figure 1B:
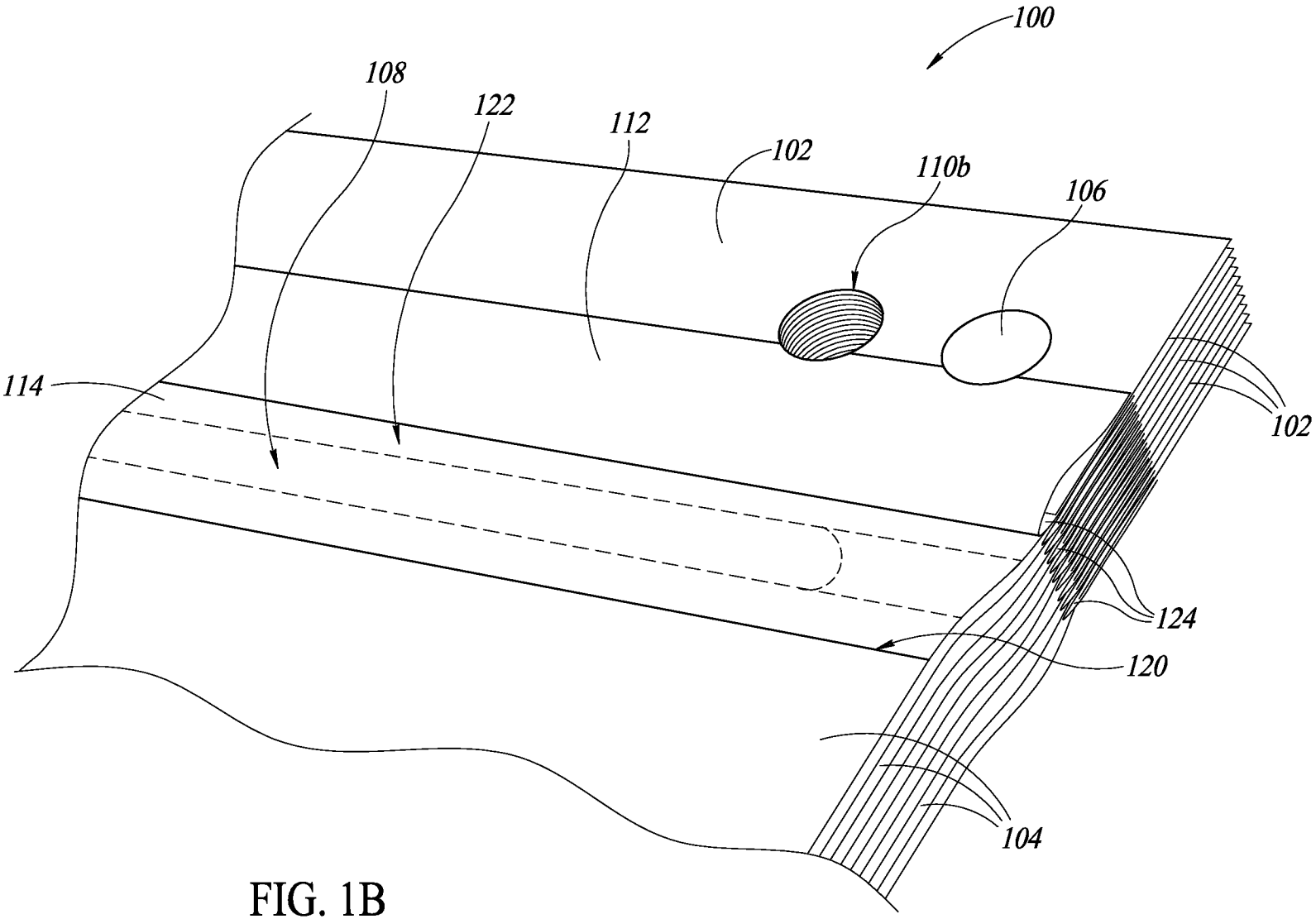
FIG. 1B is an enlarged view of the embodiment of the fixed release liner structure coupled to one or more mailer packages as shown in FIG. 1A.

FIG. 1A is a top plan view of an embodiment of a stacked packaging system 100 in which one fixed release liner 102 of the present disclosure is shown removably and detachably coupled to one mailer package 104 of the stacked packaging system 100. FIG. 1B is an enlarged view of the embodiment of the stacked packaging system 100 of a plurality of the fixed release liners 102 as shown in FIG. 1A coupled together at one or more coupling locations 106. The plurality of the fixed release liners 102 may be coupled together by one or more fasteners (e.g., one or more staples), by welds (e.g., laser welds, heat welds, etc.), or by some other like or suitable coupling structure or coupling technique at the one or more coupling locations 106. As shown in FIG. 1B, the plurality of the fixed release liners 102 are coupled together by heat welds at the coupling locations 106. As shown in FIG. 1B, each one of the fixed release liners 102 is removably or detachably coupled to a corresponding one of a plurality of the mailer packages 104 as shown in FIG. 1A. For example, each one of the fixed release liners 102 is coupled to a corresponding one of the mailer packages 104 by a corresponding adhesive layer or a plurality of adhesive layers. The plurality of fixed release liners 102 that are coupled together at least at the coupling locations 106 may be referred to as a fixed release liner structure, a fixed release liner header, or some other similar or like reference to the plurality of fixed release liners 102 that are coupled together at the coupling locations 106.

As shown in FIG. 1A, the fixed release liner 102, which is the upper most or top most fixed release liner 102 in the stacked configuration as shown in FIG. 1B, is coupled to an upper end or closure end 108 of the mailer package 104, which is at the left-hand side of FIG. 1A based on the orientation as shown in FIG. 1A. The fixed release liner includes a first opening 110*a* and a second opening 110*b* that are spaced apart from each other. The first and second openings 110*a*, 110*b* may be referred to as wickets, wicket openings, or some other suitable reference to the first and second openings 110*a*, 110*b*, respectively.

As shown in FIG. 1B, a plurality of the fixed release liners 102 are coupled together such that a plurality of the mailer packages 104 are stacked up on each other by the coupling of the fixed release liners 102 to each other at the coupling locations 106. Each respective one of one or more flaps 112 of the plurality of the fixed release liners 102 is removably coupled to a corresponding one of the closure ends 108 of the mailer packages 104. In other words, each one of the closure ends 108 of the one or more mailer packages 104 is removably coupled to a corresponding one of the one or more flaps 112 of the fixed release liners 102. Each one of the one or more mailer packages 104 is removably coupled to each one of the one or more flaps 112 of the fixed release liners 102 by a corresponding adhesive layer. A respective one of the one or more mailer packages 104 may be individually removed from the corresponding flap 112 by individually pulling on the respective mailer package 104 to overcome the adhesive layer that couples the closure end 108 of the respective mailer package 104 to the corresponding flap 112. Overcoming the adhesive layer results in decoupling the respective mailer package 104 from the corresponding flap 112 of the corresponding fixed release liner 102 of the fixed release liner structure.

Each one of the fixed release liners 102 further includes the one or more wickets 110*a*, 110*b* that extend into and through each one of the fixed release liners 102. The one or more wickets 110*a*, 110*b* in each one of the fixed release liners 102 are aligned with each other such that the wickets 110*a*, 110*b* of the fixed release liners 102 may be utilized to fixedly couple the fixed release liners 102 to an external surface (e.g., a wall, a tablet, or some other suitable type of surface) in a fixed or stationary position with respect to the external surface. For example, one or more pins (e.g., tacks, nails, or some other suitable type of structure or component) may be passed through the one or more wickets 110*a*, 110*b* of the fixed release liners 102, and the pins may then be inserted into the external surface to fixedly couple or stationarily mount the fixed release liners 102 to the external surface by pushing the pins into the external surface. Once the stacked packaging system 100 is mounted to the external surface, a packaging employee or worker may then quickly and easily remove the one or more mailer packages 104 from the fixed release liners 102 fixedly coupled to the external surface by simply pulling on respective ones of the mailer packages 104 removing them one by one from the fixed release liners 102 in succession based on their stacked configuration (see FIG. 1B of the present disclosure).

Closure flaps 114 of each of the one or more mailer packages 104 are coupled to the one or more flaps 112 of the fixed release liners 102 such that when one of the mailer packages 104 is removed from the corresponding fixed release liner 102, the corresponding closure flap 114 is removed from the corresponding flap 112 of the corresponding fixed release liner 102. The closure flaps 114 are at the closure ends 108 of the mailer packages 104. After removing the mailer package 104, at least enough of the adhesive layer remains on the closure flap 114 such that enough of the adhesive layer is left behind and remains on the closure flap 114 for adhering the closure flap 114 to an outer surface 116 of the mailer package 104 to seal a cavity 118 within the mailer package 104 by utilizing the remainder of the adhesive layer on the closure flap 114. For example, the closure flap 114 may be folded over an opening 120 in fluid communication with the cavity 118 at the closure end 108 of the mailer package 104 and an inner surface 122 of the closure flap 114 at which the adhesive layer is present is then coupled to the outer surface 116 of the mailer package 104 sealing off the cavity 118 and the opening 120 to ship an item or product within the mailer package 104 to a consumer, customer, purchaser, etc.

In at least the embodiment as shown in FIG. 1B, each one of the flaps 112 of the fixed release liners 102 has a curved or folded end 124 such that each of the flaps 112 is folded over itself and is made of a single continuous material. The curved or folded end 124, which may have a U-like shape (see FIGS. 1B and 2A-2F of the present disclosure), a V-like shape (see FIGS. 3A-3D of the present disclosure), or some other suitable curved or folded shape, has a respective end coupled to a corresponding one of closure flaps 114 of the mailer packages 104. Removing the mailer packages 104 from the flaps 112 of the fixed release liners 102 of the fixed release liner structure will be discussed in detail with respect to FIGS. 2A-2F of the present disclosure.

In at least the embodiment as shown in FIG. 1B, each one of the closure flaps 114 of the mailer packages 104 each includes a plurality of perforations 126 that define a tear strip 128 that allows a consumer, customer, purchaser, etc. to open the mailer package 104 to access a product or item that has been packaged within the mailer package 104. For example, the user may pull on the tear strip 128 tearing a plurality of extensions between the plurality of perforations 126 allowing the consumer, customer, purchaser, etc. to gain access to the cavity 118 through the opening 120 in which the product or item is present during shipment without overly damaging the mailer package 104. This allows the consumer, customer, purchaser, etc. to reutilize the mailer package 104 if the product or item is to be returned to a seller or distributor.

FIGS. 2A-2F are directed to an embodiment of a method of removing the mailer packages 104 from the flaps 112 of the fixed release liners 102 as shown in FIG. 1B. While not shown in FIGS. 2A-2F, the fixed release liners 102 may be fixed to an external surface 130 (e.g., a wall, a table, etc.) by placing a fastener (e.g., tack, pin, etc.) through the wickets or openings 110*a*, 110*b* fixing the fixed release liners 102 such that the fixed release liners 102 of the stacked packaging system 100 are mounted to the external surface 130, which may be referred to as a wall herein. The packaging employee may then remove the mailer packages 104 from the fixed release liners 102 one by one in succession based on their stacked configuration, and, as the mailer packages 104 are removed one by one from the fixed release liners 102, the fixed release liners 102 remain coupled together (e.g., heat welds, staples, etc.) and remain mounted to the wall 130 until all of the mailer packages 104 have been utilized and removed from the fixed release liners 102 of the stacked packaging system 100. As the fixed release liners 102 are coupled together by staples or heat welds and are mounted to the wall 130 by the tacks, the fixed release liners 102 will remain together and will be heavier together than if they were not coupled together by the staples or heat welds and instead were simply laying around individually and not coupled together.

Figure 2A:
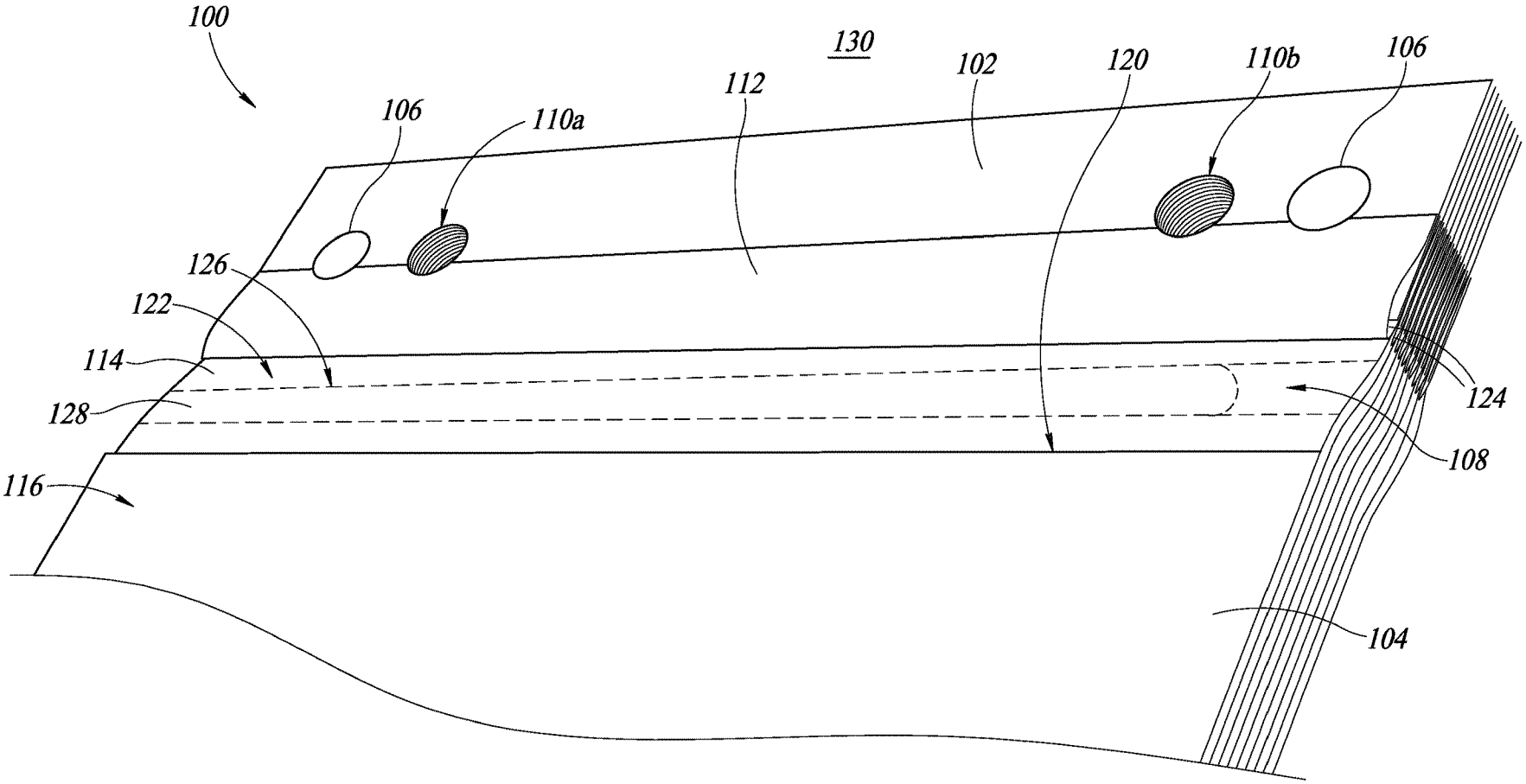
FIGS. 2A-2D are perspective views of an embodiment of a method of removing a first mailer package from the embodiment of the fixed release liner structure as shown in FIGS. 1A and 1B.

As shown in FIG. 2A, the fixed release liners are mounted to the wall 130 as discussed earlier such that the mailer packages 104 may be removed from the fixed release liners 102 by pulling down individual ones of the mailer packages 104. For example, the user (e.g., a packaging employee or worker) grabs or grasps one of the mailer packagers 104 and pulls down on the mailer package 104.

Figure 2B:
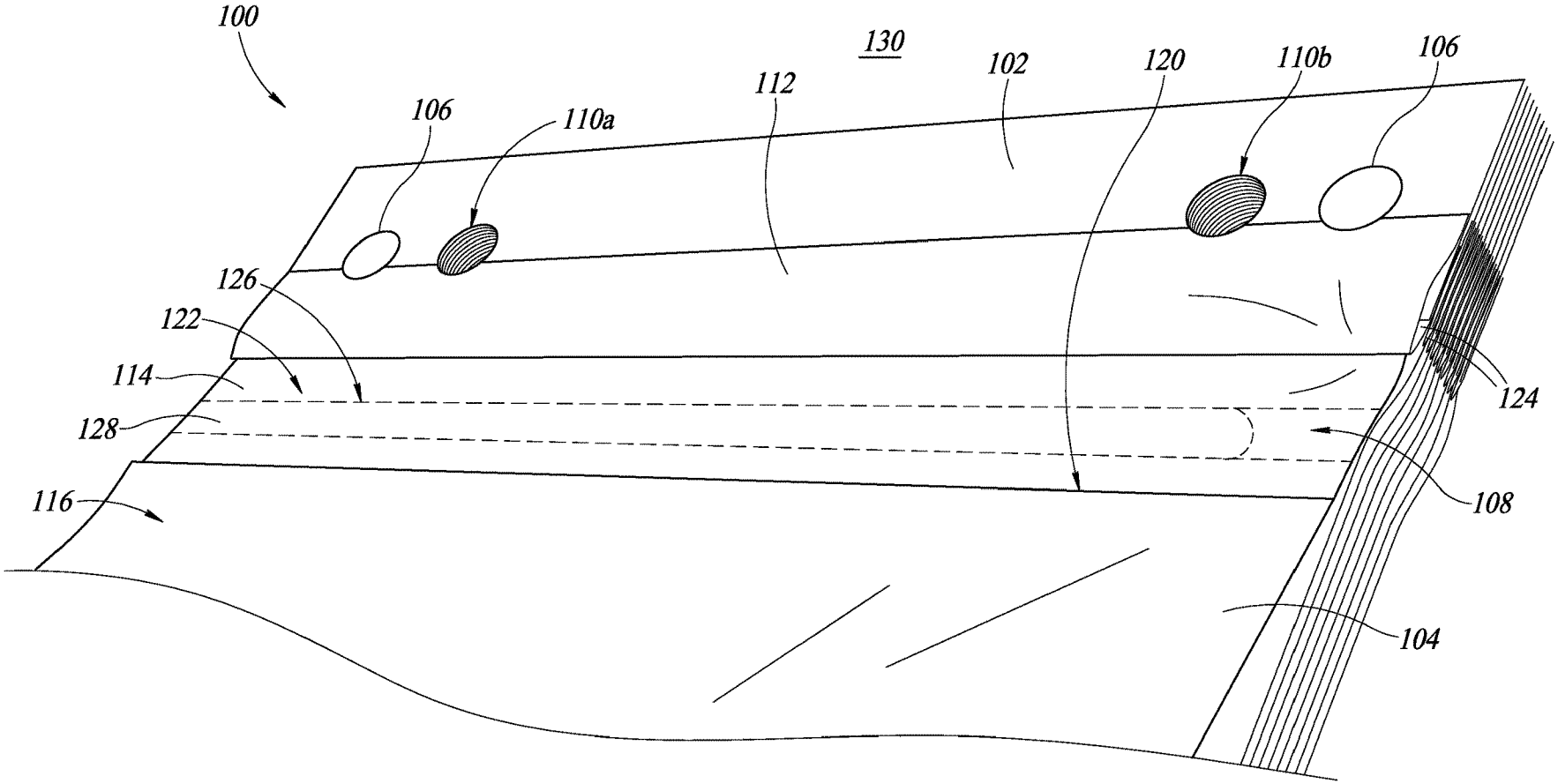
Figure 2C:
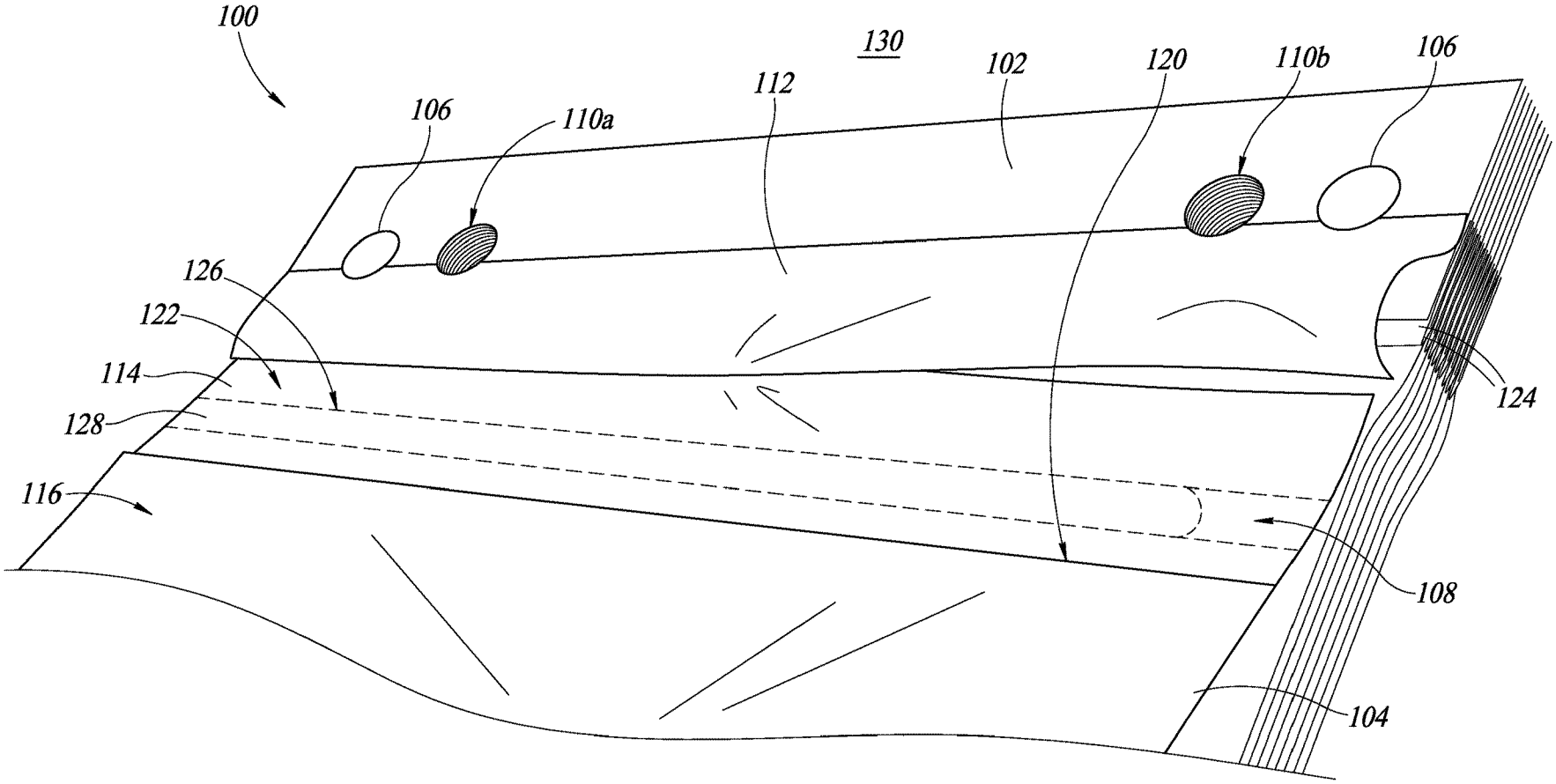

As shown in FIGS. 2B and 2C, as the user pulls on a first one of the mailer packages 104, the user applies enough of a pulling force to overcome the adhesive layer such that the closure flap 114 at the closure end 108 of the first mailer package 104 decouples from the corresponding fixed release liner 102. Some or all of the adhesive layer previously coupling the closure flap 114 of the mailer package 104 to the corresponding fixed release liner 102 remains on the inner surface 122 of the closure flap 114 such that the user may then close off the mailer package 104 by pressing the remaining portion of the adhesive layer on the inner surface 122 of the closure flap 114 to the outer surface 116 of the mailer package 104.

Figure 2D:
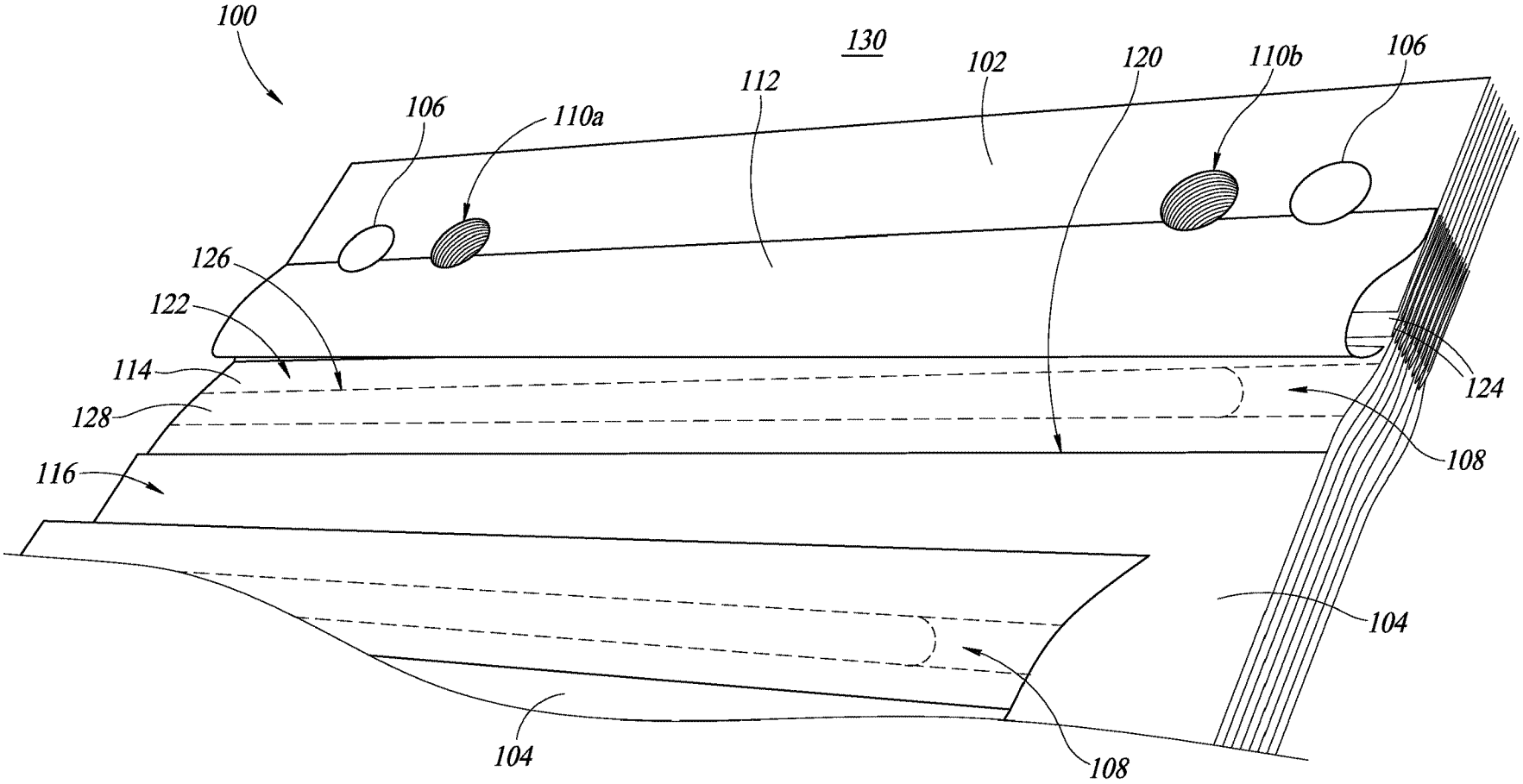

As shown in FIG. 2D, once the user has applied enough of a pulling force for enough time, the first mailer package 104 is removed from the corresponding one of the corresponding fixed release liners 102 and the user may then pack and seal the first mailer package 104 to ship an item or product to a consumer, customer, purchaser, etc. placed within the mailer package 104. After the first mailer package 104 is removed, the corresponding fixed release liner 102 previously coupled to the first mailer package 104 remains coupled to the other ones of the corresponding fixed release liners coupled to the other ones of the mailer packages. Alternatively, in some embodiments, the user may have already placed the product or item within the cavity 118 of the mailer package 104 before removing the mailer package 104 from the corresponding flap 112 of the fixed release liners 102.

Figure 2E:
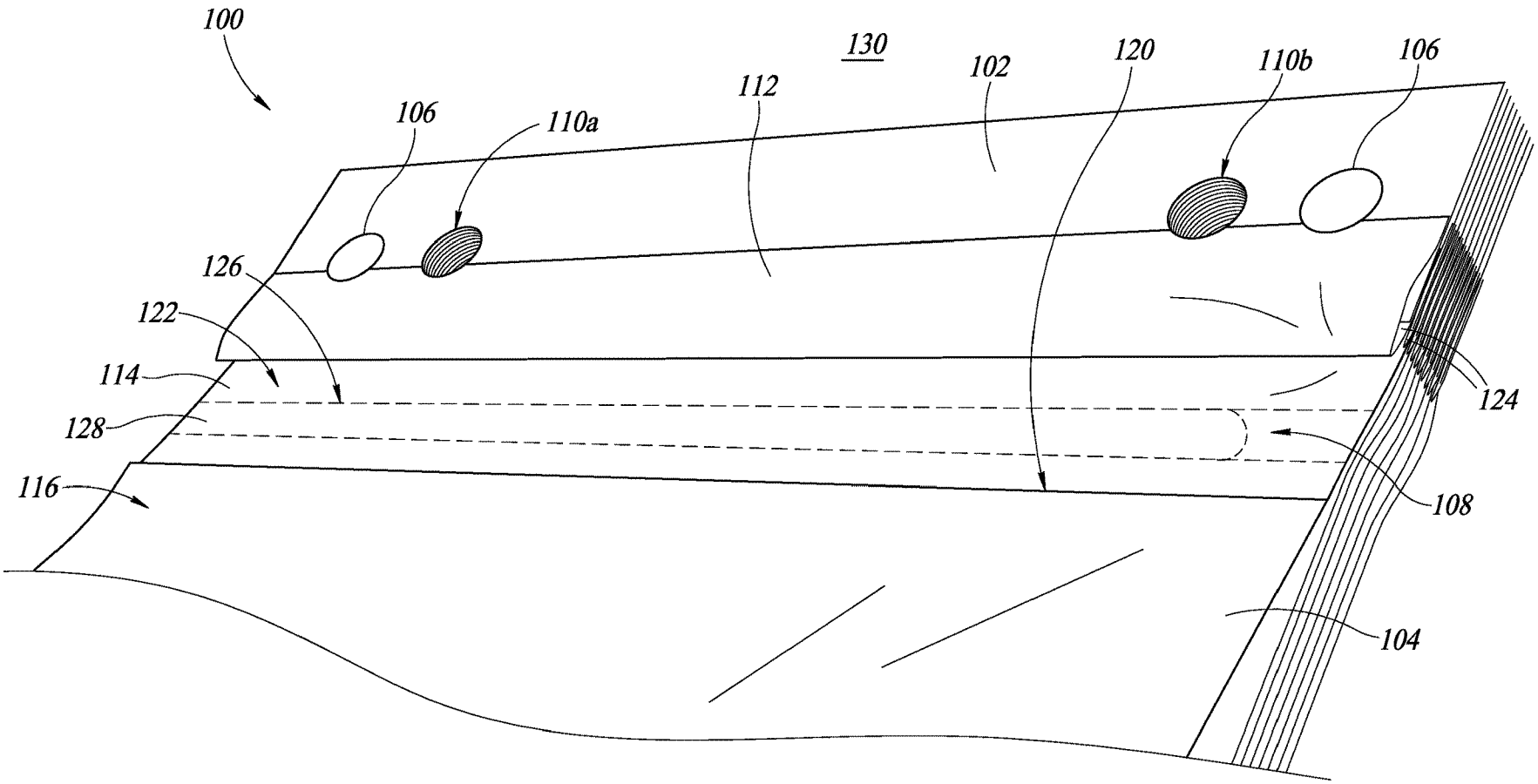
FIGS. 2E-2F are perspective views of the embodiment of the method of removing a second mailer package from the embodiment of the fixed release liner structure successively after the first mailer package has been removed from the embodiment of the fixed release liner structure as shown in FIGS. 2A-2D.
Figure 2F:
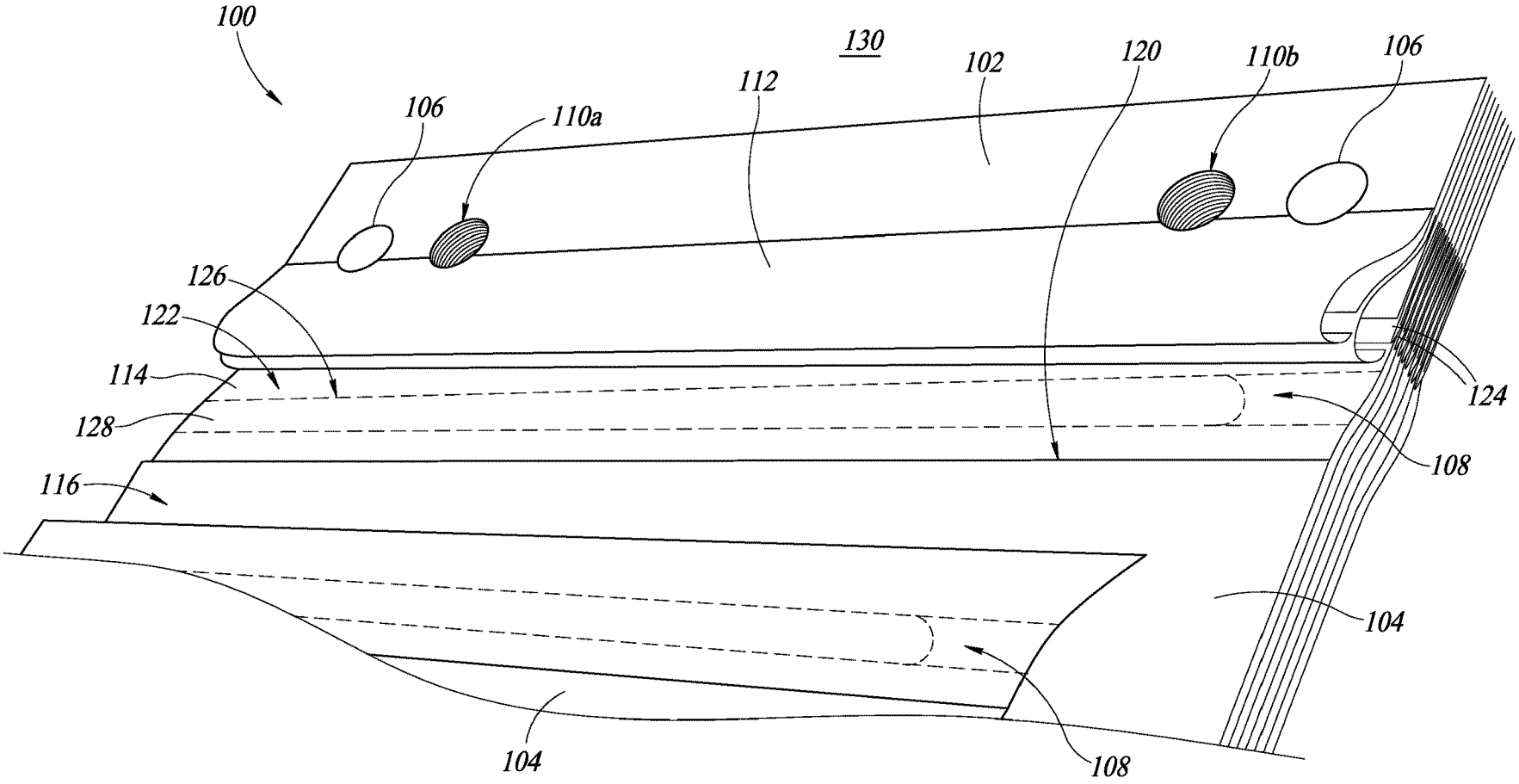

After the first mailer package has been removed as shown in FIG. 2D, a second mailer package 104 is removed from the corresponding fixed release liner 102 as shown in FIGS. 2E and 2F. The same process as discussed with respect to FIGS. 2A-2C is carried out by the user to remove the second mailer package 104 from the corresponding flap of the fixed release liners 102, and the corresponding fixed release liner 102 previously coupled to the second mailer package 104 remains coupled to the other ones of the fixed release liners 102, which includes the corresponding fixed release liner 102 previously coupled to the first mailer package 104. This process may be repeated over and over again in succession until all of the mailer packages 104 have been removed from the fixed release liners 102 by a packaging employee packaging various products or items to be shipped to consumers, customers, purchasers, etc. of the various products or items.

Once all of the mailer packages 104 are removed from the fixed releaser liners 102, the fixed release liners 102 may be decoupled from the wall 130 by removing the tacks from the plurality of wickets 110*a*, 110*b* such that the fixed release liners 102 are removed from the wall 130. A new set of fixed release liners 102 with a new set of mailer packages 104 is then mounted to the wall 130 by the tacks. This allows for the user to quickly deploy new mailer packages 104 to continue to package items or products to be shipped to consumers, customers, purchasers, etc. After the fixed release liners 102 have been removed and replaced by the new set of fixed release liners 102 such that a new stacked packaging system 100 replaces the old packaging system 100, the fixed release liners 102 are placed within a waste receptacle (e.g., waste bin, waste can, waste container, etc.). Once the waste receptacle is full the waste receptacle may be emptied into a larger commercial waste receptacle outside a packaging facility to be transferred to a waste processing site (e.g., garbage dump, recycling center, etc.). As the fixed release liners 102 are coupled together by one or more fasteners or heat welds at the coupling locations 106, the fixed release liners 102 will remain together and together will be heavier than not being coupled together and thrown about loosely alone and individually. This heavier weight of the fixed release liners 102 being coupled together at the coupling locations 106 reduces the likelihood of or prevents the fixed release liners 102 blowing away out of or exiting the commercial waste receptacle such that the fixed release liners 102 enter the environment as pollution, which may be potentially harmful to the environment such as surrounding habitats and wildlife. In other words, the heavier weight of the fixed release liners 102 being coupled together reduces the likelihood of or prevents pollution from entering the environment.

FIGS. 3A-3E are directed to an alternative embodiment of a stacked packaging system 200 and a method of removing mailer packages 104 from an alternative embodiment of fixed release liners 102 of the present disclosure. The process for removing the mailer packages 104 from the fixed release liners 102 as shown in FIGS. 3A-3E is the same as or similar to the process as discussed earlier with respect to FIGS. 2A-2F. Accordingly, the process for removing the mailer packages 104 from the flaps 112 of the fixed release liners 102 as shown in FIGS. 3A-3E should become readily apparent based on the discussion with respect to FIGS. 2A-2F and based on the illustrations as shown in FIGS. 3A-3E.

Figure 3A:
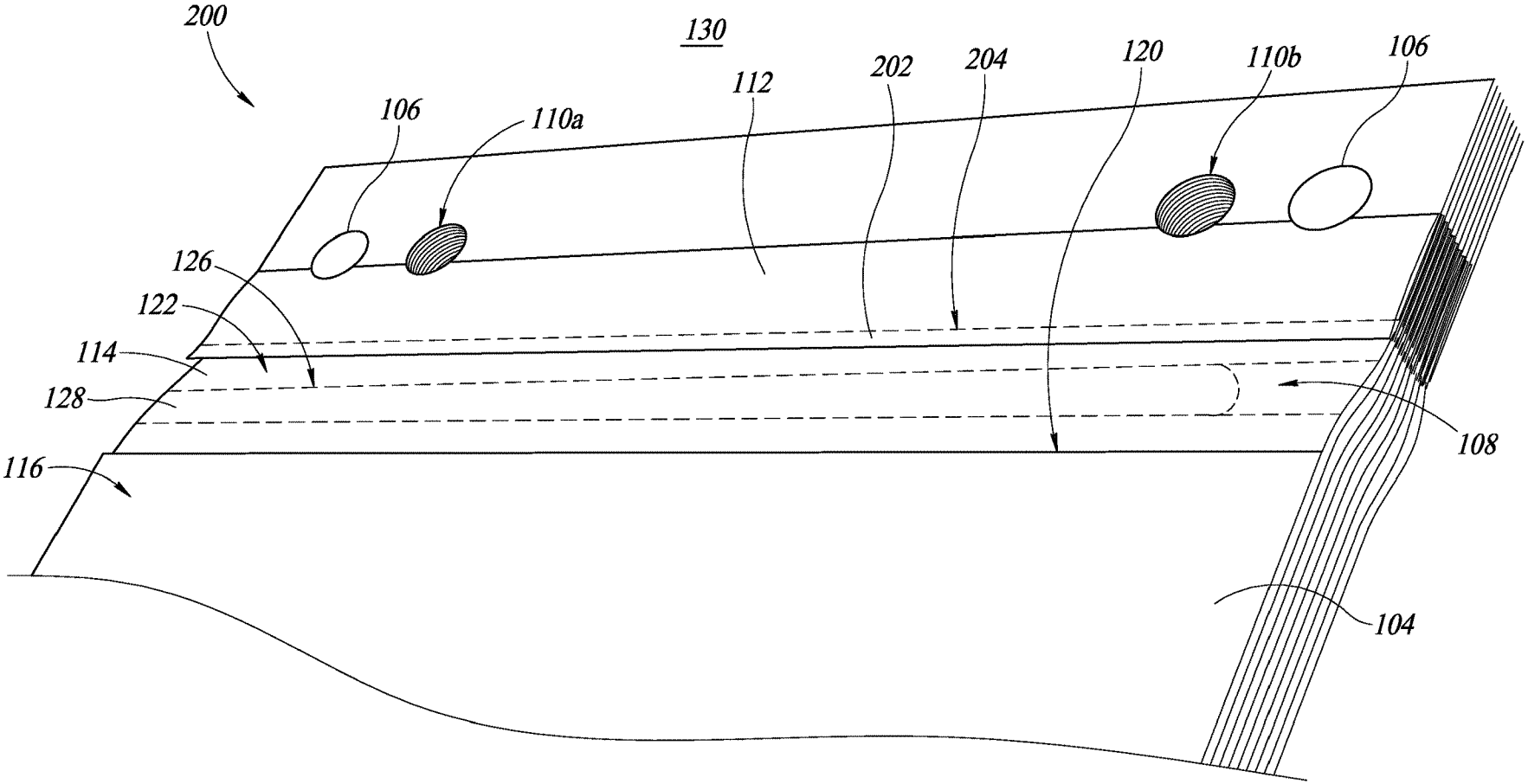
FIGS. 3A-3D are perspective views directed to an alternative embodiment of a method of removing a mailer package from an alternative embodiment of a fixed release liner structure of the present disclosure.
Figure 3B:
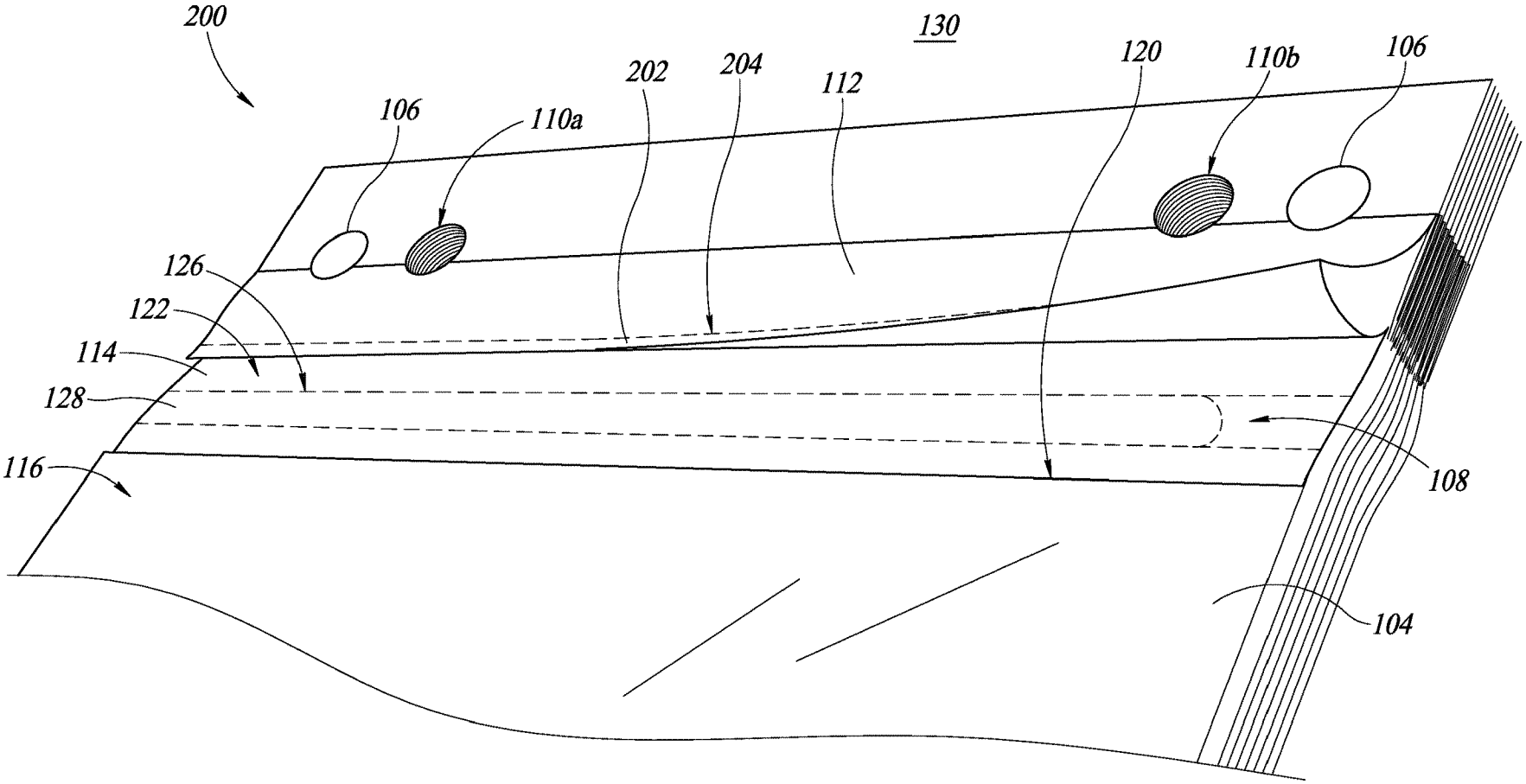
Figure 3C:
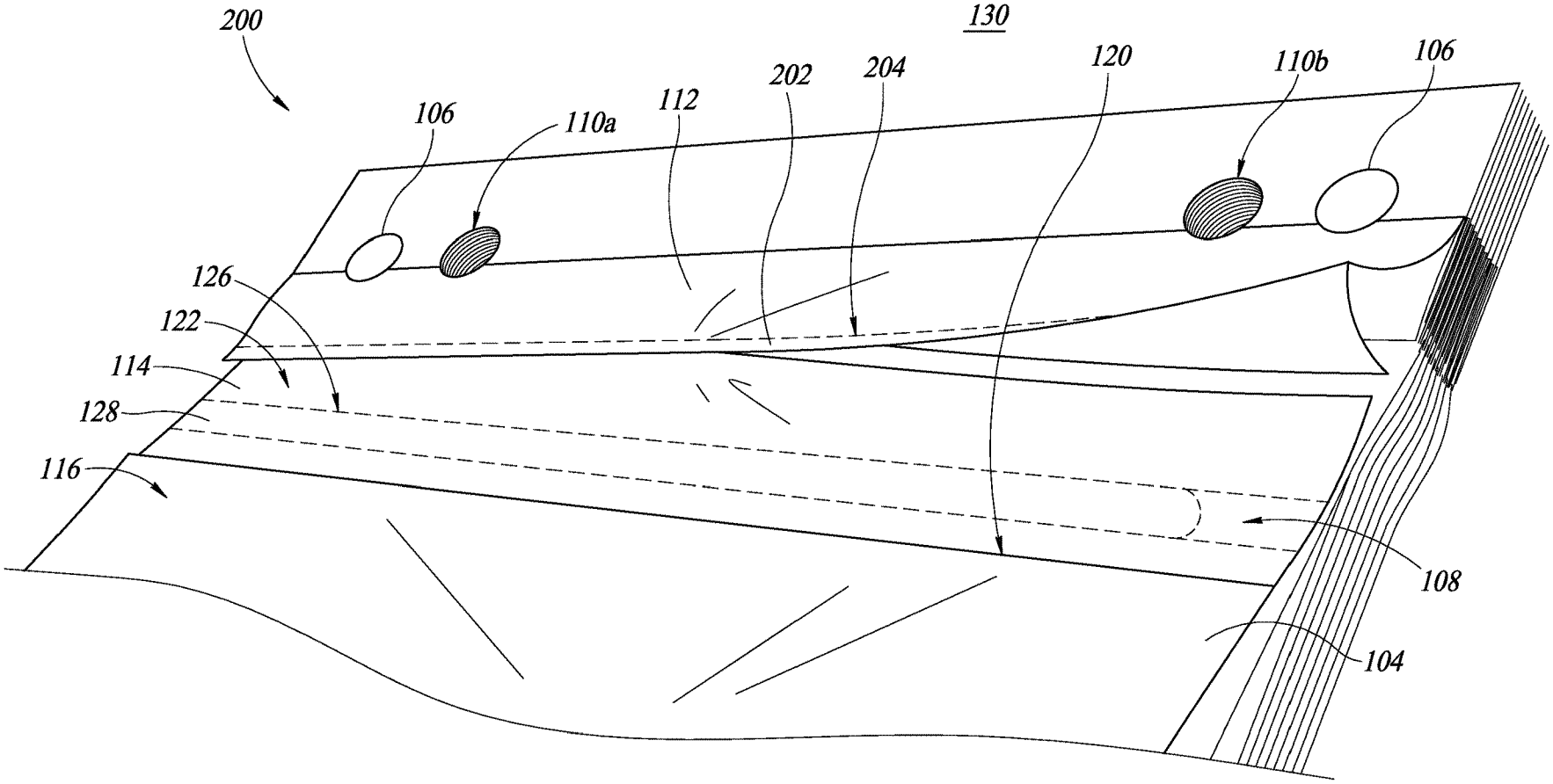
Figure 3D:
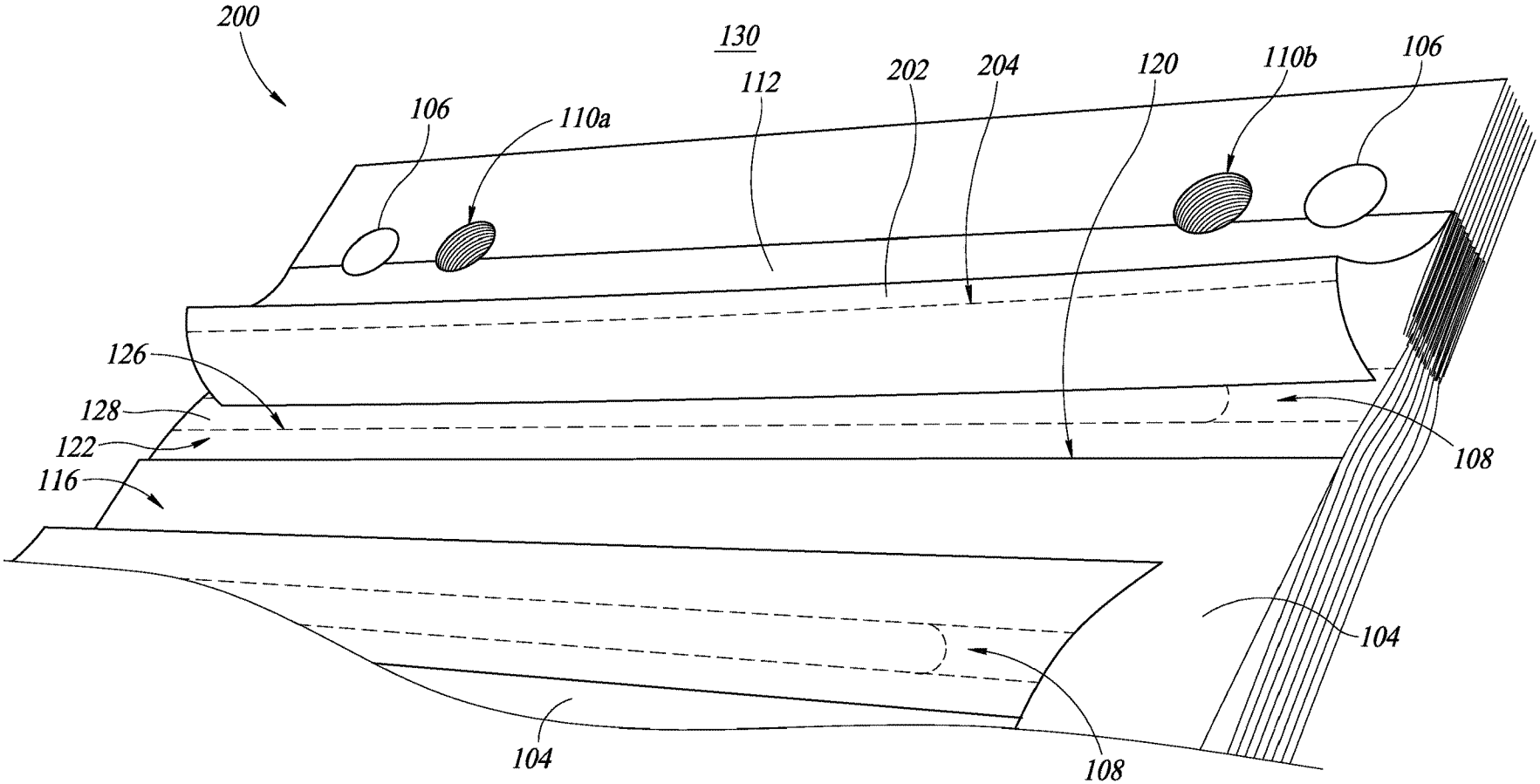
Figure 4A:
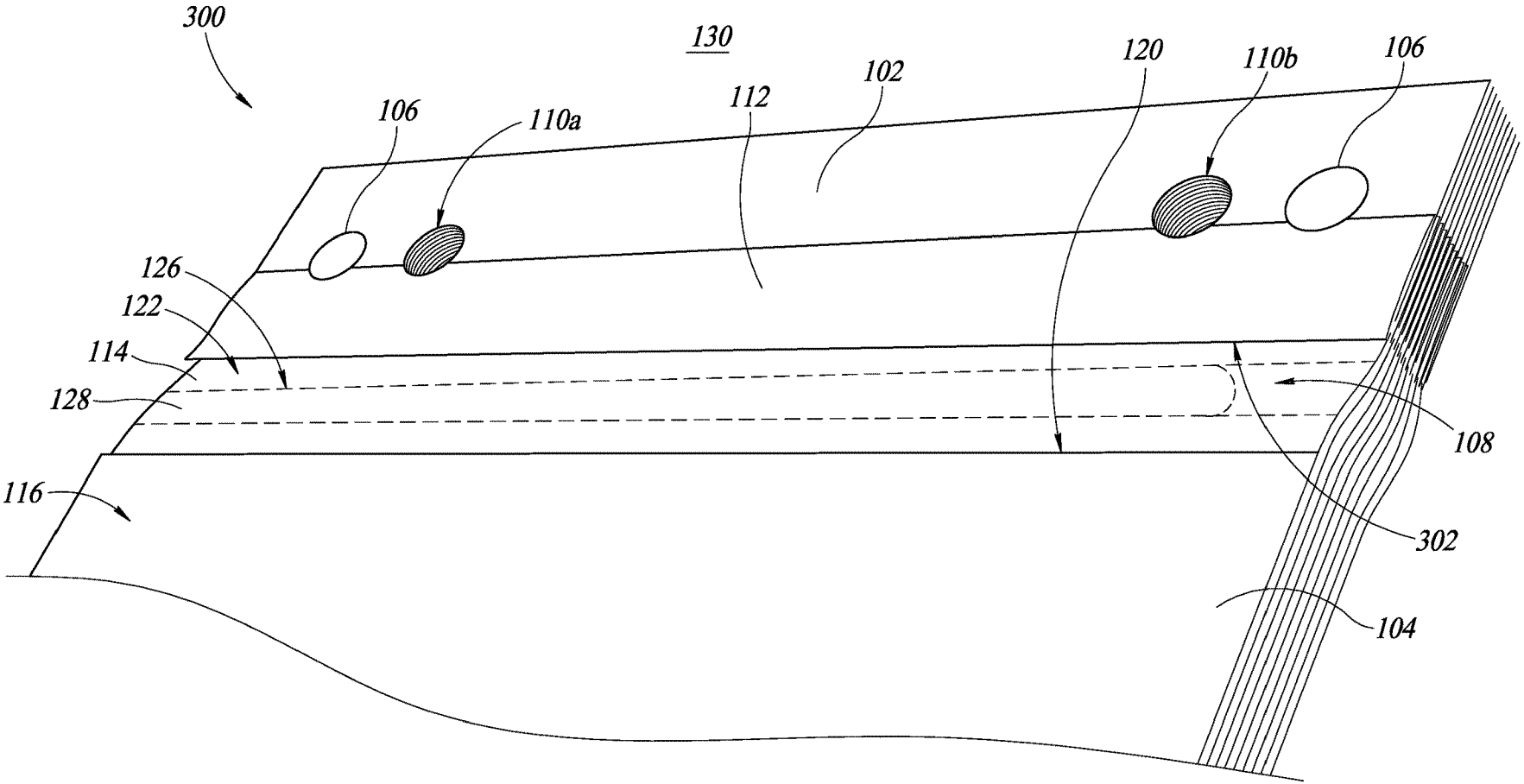
FIGS. 4A-4D are perspective views directed to an alternative embodiment of a method of removing a mailer package from an alternative embodiment of a fixed release liner structure of the present disclosure.
Figure 4B:
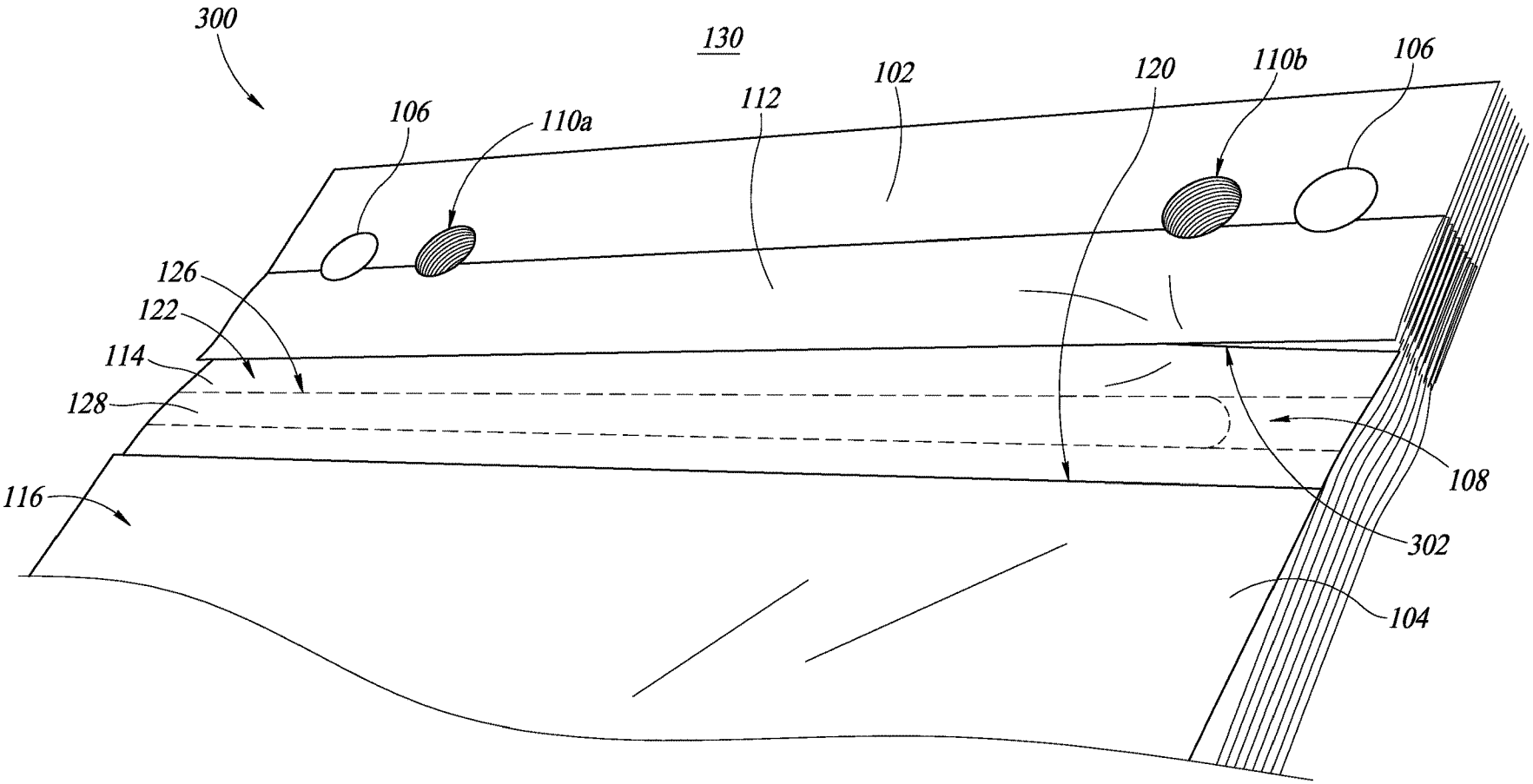
Figure 4C:
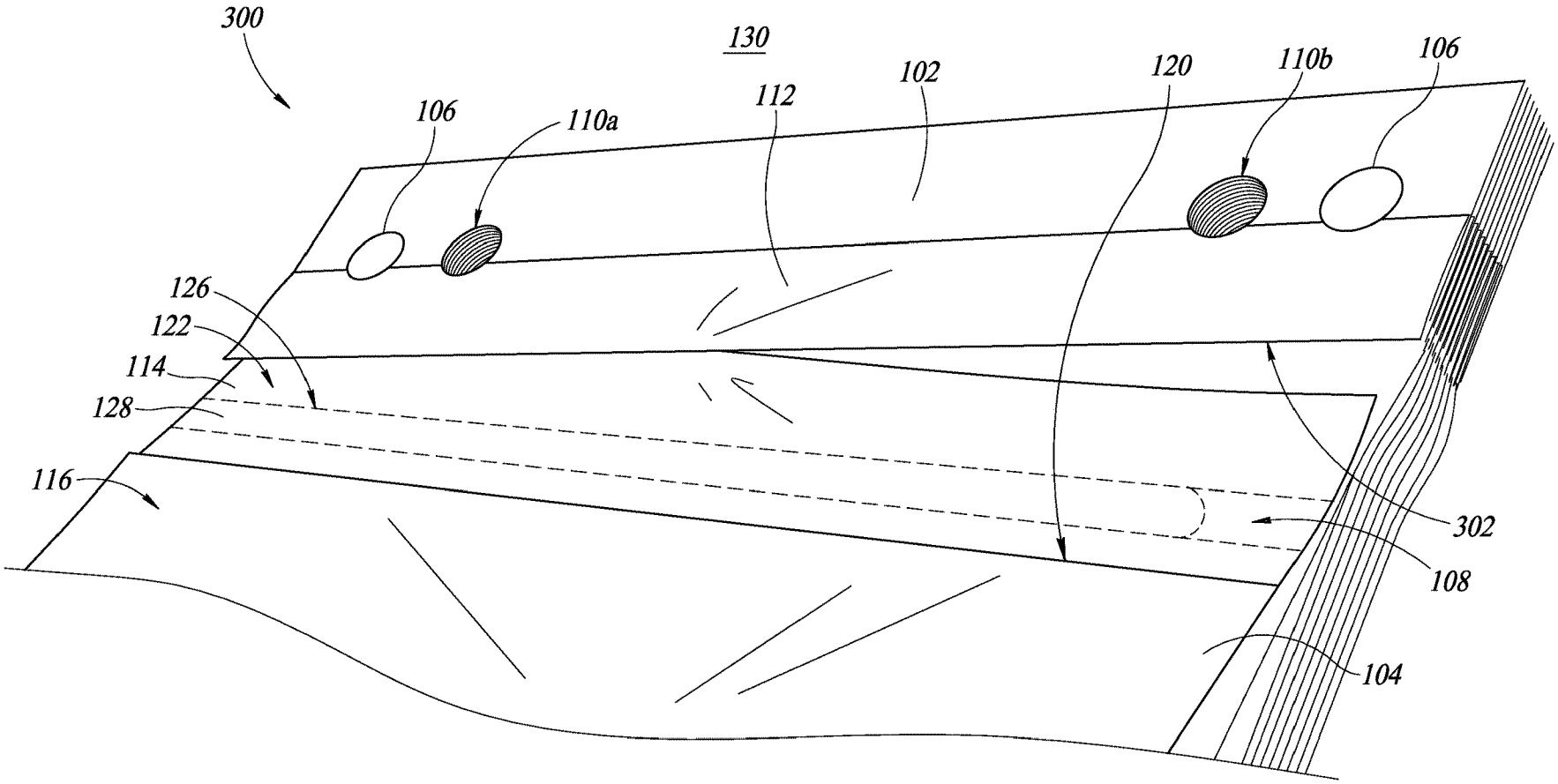
Figure 4D:
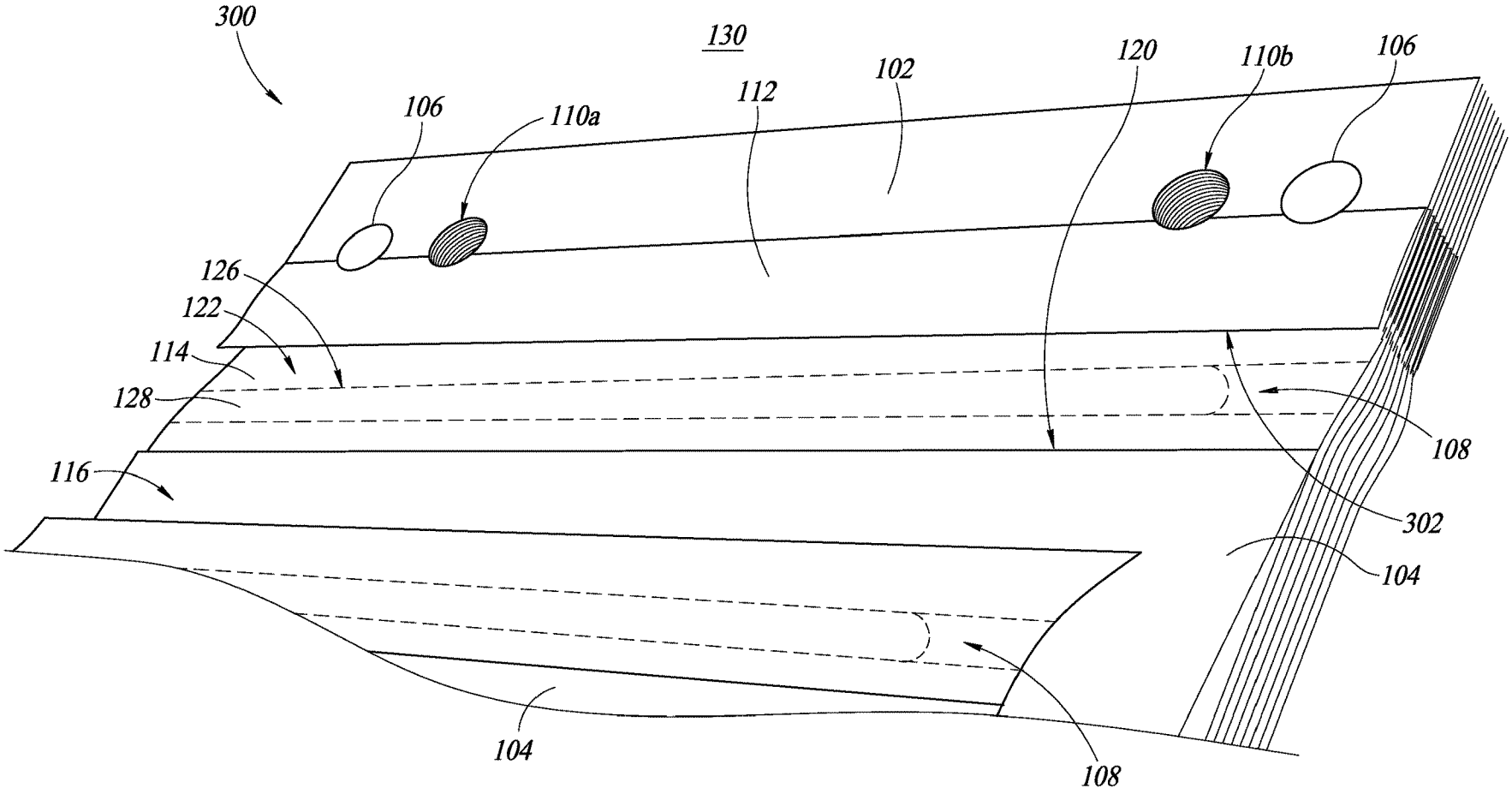

As readily visible in FIG. 3B, the alternative embodiment of the flap 112 of the fixed release liner 102 is shown as including a fold 202 along the flap 112, which is removably coupled to a mailer package 104 of the present disclosure, such that the flap 112 of the fixed release liner 102 has a V-like shape or structure. In this alternative embodiment of the stacked packaging system 200 as shown in FIGS. 3A-3E, each one of the flaps 112 of the fixed release liners 102 may include a first portion and a second portion that are coupled together along or near the fold 202. For example, a first portion and a second portion of each one of the flaps 112 of the fixed release liners 102 as shown in FIGS. 3A-3E may be stitched together along line 204, may be heat welded together along line 204, or may be coupled together with some other like or suitable coupling technique. In some alternative embodiments, the first and second portions may be integral with each other and made of a single continuous material. In some alternative embodiments, the first and second portions may be heat welded together. The flaps 112 with the V-like shapes or structures allows for the mailer packages 104 as shown in FIG. 3B to be easily removed from the corresponding flaps 112 of the fixed release liners 102 of the fixed release liner structure. Removing the mailer packages 104 from the fixed release liners 102 of the fixed release liner structure is performed in the same or similar fashion as discussed above with respect to FIGS. 2A-2F of the present disclosure.

FIGS. 4A-4D are directed to an alternative embodiment of a stacked packaging system 300 and an alternative embodiment of a method of removing the mailer packages 104 from the alternative embodiment of the flaps 112 of the fixed release liners 102 of the present disclosure. The process for removing the mailer packages 104 from the fixed release liners 102 as shown in FIGS. 4A-4D is the same or similar as the process as discussed earlier with respect to FIGS. 2A-2F. Accordingly, the process for removing the mailer packages 104 from the flaps 112 of the fixed release liners 102 as shown in FIGS. 4A-4D should become readily apparent based on the discussion with respect to FIGS. 2A-2F and based on the illustrations as shown in FIGS. 4A-4D.

In the alternative embodiment of the stacked packaging system 300 as shown in FIGS. 4A-4D, the alternative embodiment of the flaps 112 of the fixed release liner 102 are flat continuous flaps such that the flaps 112 may be relatively straight as compared to the U-shaped embodiment of the flaps 112 as shown in FIGS. 2A-2F of the present disclosure and the V-shaped embodiment of the flaps 112 as shown in FIGS. 3A-3E of the present disclosure. In other words, the flaps 112 as shown in FIGS. 4A-4D do not include a curved flap or a fold like those as shown in the embodiments in FIGS. 1A, 1B, 2A-2F, and 3A-3D, respectively. For example, the flaps 112 of the fixed release liners 102 do not include the U-like shape or V-like shape of the flaps 112 as shown in FIGS. 2A-2F and 3A-3D, respectively. Each one of the flaps 112 of the fixed release liners 102 includes an end 302 that is coupled to a corresponding one of the mailer packages 104. The ends 302 may be coupled to the corresponding ones of the mailer packages 104 by an adhesive. However, in some alternative embodiments, the fixed release liners 102 may be physically coupled to the mailer packages by tear away portions between perforations that are present at the end of the flaps 112 as shown in FIGS. 4A-4D such that the tear away portions are torn to remove and decouple the mailer packages 104 from the flaps 112 of the fixed release liners 102.

Figure 5:
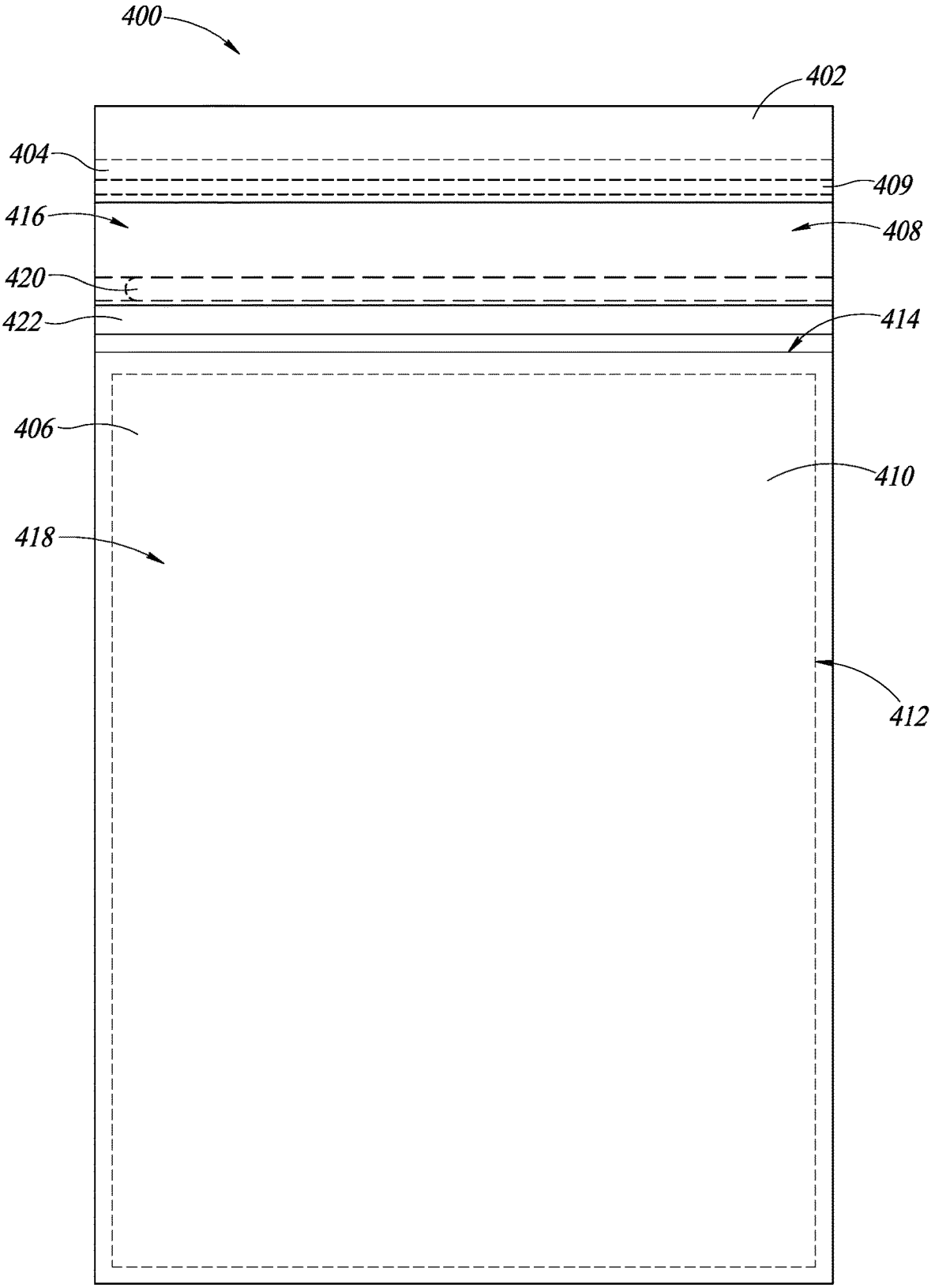
FIG. 5 is a front view of an embodiment of a stacked packaging system including fixed release liners coupled to mailer packages of the present disclosure.

FIG. 5 is a front view of an alternative embodiment of stacked mailer package system 400 including fixed release liners 402 coupled together and each including flaps 404 coupled to corresponding ones of one or more mailer packages 406 of the present disclosure. Similar to as shown in FIG. 2B, multiple ones of the mailer packages 406 as shown in FIG. 5 may be stacked together by coupling multiple ones of the fixed release liners 402 as shown in FIG. 5. For example, multiple ones of the fixed release liners 402 may be coupled together by stapling multiple ones of the fixed release liners 402 together. Alternatively, when the fixed release liners 402 are made of a poly-plastic material such as a polyethylene material, the fixed release liners 402 may be heat welded or laser welded together. The fixed release liners 402 and the flaps 404 of the fixed release liners 402 may be the same as or similar to those discussed herein with respect to FIGS. 1A-1B, 2A-2F, 3A-3D, and 4A-4D, respectively.

As shown in FIG. 5, the fixed release liners 402 are coupled to closure flaps 408 of the mailer packages 406. The fixed release liners 402 as shown in FIG. 5 may be mounted to an external surface utilizing alligator clips or some other type of component or structure that may be utilized to mount the fixed release liners 402 to an external surface, for example, similar to the external surface 130.

While not present in the embodiment as shown in FIG. 5, in some alternative embodiments, the fixed release liners 402 include one or more openings (e.g., wickets), which may be similar to the openings 110*a*, 110*b* (e.g., wickets) as shown in FIGS. 1A and 1B, that extend entirely through the fixed release liners 402. In this alternative embodiment, a pin or tack may be inserted into each one of the openings to mount the fixed release liners 402, which are all coupled together, to an external surface such as a wall, for example, similar to the external surface 130. The fixed release liners 402 may be referred to as primary liners, primary headers, release headers, or some other suitable or like reference to the fixed release liners 402 of the fixed release liner structure. Respective flaps 404 of the fixed release liners 402 are each coupled to a corresponding one of the closure flaps 408 of the mailer packages 406 by a corresponding one of one or more primary adhesive layers 409, which are covered by a respective portion of a corresponding flap 404 of one of the fixed release liners 402. The primary adhesive layers 409 may be referred to as closure adhesive layers. For example, the respective portion of the fixed release liner 402 covering the primary adhesive layer 409 is coupled to the respective closure flap 408 by the respective primary adhesive layer 409.

The closure flap 408 of the mailer package 406 as visible in FIG. 5 is coupled to a package portion 410 of the mailer package 406. The package portion 410 of the mailer package 406 includes a cavity 412, which may be the same or similar to the cavity 118, within the package portion 410 in which an item or a product may be placed within to ship the item or the product to a consumer. The package portion 410 of the mailer package 406 further includes an opening 414, which may be the same as or similar to the opening 120, in fluid communication with the cavity 412 in the package portion 410 such that the item or the product may be placed within the cavity 412 through the opening 414.

The opening 414 may be sealed off by decoupling the closure flap 408 of the mailer package 406 from the fixed release liner 402. Decoupling the closure flap 408 from the fixed release liner 402 exposes a portion of the primary adhesive layer 409 still remaining on an inner surface 416 of the closure flap 408. The opening 414 may be sealed off by folding the closure flap 408 over and pressing the remaining portion of the primary adhesive layer 409 on the inner surface 416 to an outer surface 418 of the package portion 410 of the mailer package 406. The inner surface 416 may be the same as or similar to the inner surface 122, and the outer surface 418 may be the same as or similar to the outer surface 116.

The mailer package 406 further includes a tear strip 420 and a secondary liner 422 covering a secondary adhesive layer under the secondary liner 422. The tear strip 420 and the secondary liner 422 are on the inner surface 416 of the closure flap 408. The tear strip 420 allows a consumer who is to receive the item or the product shipped within the mailer package 406 to easily and simply access the cavity 412 through the opening 414 by pulling on the tear strip 420 removing the tear strip 420 from the mailer package 406. Removing the tear strip 420 allows the consumer to open the closure flap 408 exposing the opening 414 and providing access to the cavity 412 within the package portion 410. The consumer may then remove the item or the product from the cavity 412 such that the consumer may obtain the item or the product within the cavity 412 through the opening 414.

If the consumer is to return the item or the product after removing the item or the product from the package portion 410 and inspecting the product or item, the consumer may reutilize the mailer package 406 to ship the product back to the seller. For example, the consumer places the item or product to be returned within the cavity 412 through the opening 414. After placing the item or the product within the cavity 412 through the opening 414, the consumer then removes the secondary liner 422 from the inner surface 416 of the closure flap 408 exposing the secondary adhesive layer previously underneath and covered by the secondary liner 422. Once the secondary adhesive layer is exposed, the consumer folds over the closure flap 408 and presses the secondary adhesive layer against the outer surface 418 of the mailer package 406 adhering the closure flap 408 to the outer surface 418 of the mailer package 406. The consumer may then drop off the mailer package 406 that contains the item or product to be returned to a mailing outlet.

As may readily be seen in FIG. 5, the tear strip 420 is positioned between the secondary liner 422 and the primary adhesive layer 409 such that the secondary liner 422 is not removed from the closure flap 408 when the tear strip 420 is torn off by the consumer. This provides the ability for the consumer to reutilize the mailer package 406 if the item or the product is to be returned to a seller or distributor of the item or product.

Figure 6:
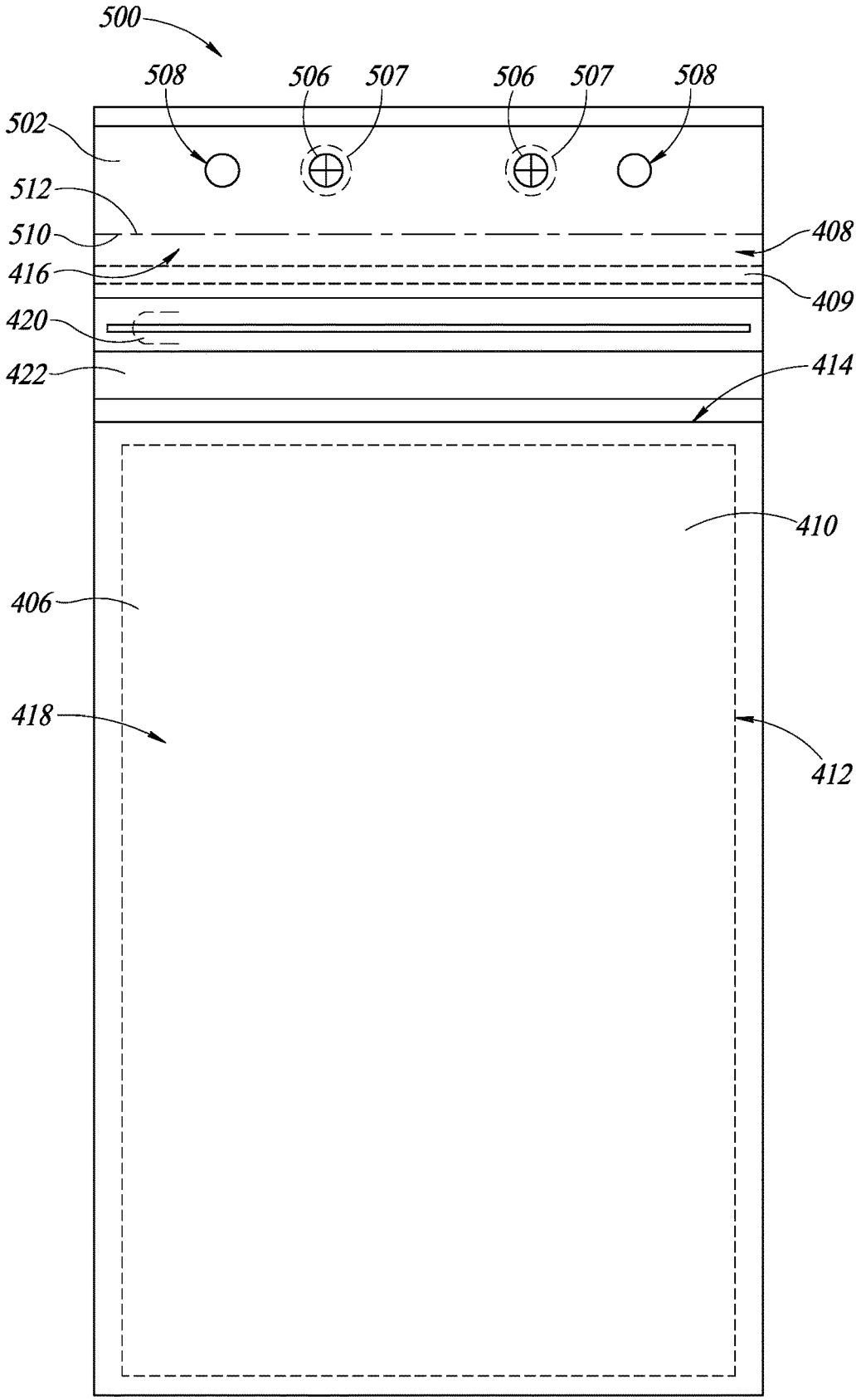
FIG. 6 is a front view of an alternative embodiment of a stacked packaging assembly including fixed release liners coupled to mailer packages of the present disclosure.

FIG. 6 is a front view of an alternative embodiment of a stacked packaging system 500 including alternative embodiments of fixed release liners 502 that are each coupled to a corresponding one of the mailer packages 406. For the sake of simplicity or brevity of the present disclosure, the following discussion of the stacked packaging system 500 as shown in FIG. 6 will focus on additional or different details of the stacked packaging system 500 as compared to the stacked packaging system 400 as shown in FIG. 5.

The fixed release liners 502 include a plurality of weld pins 506 that may be utilized for coupling multiple ones of the fixed release liners 502 together. For example, in some embodiments, the plurality of weld pins 506 may be surrounded by perforated areas 507 such that prongs of a paper prong fastener may pass through the weld pins 506 to couple ones of the fixed release liners 502 together such that the ones of the fixed release liners 502 are held together by the paper prong fastener. Alternatively, in some embodiments, the fixed release liners 502 may be welded together (e.g., heat, laser, adhesive, etc.) at the weld pins 506 and the weld pins 506 may not be perforated such that the fixed release liners 502 are robustly melted together at the plurality of weld pins 506 and the perforated areas 507 are not present around the weld pins 506.

Once the fixed release liners 502 are coupled together utilizing the weld pins 506, which may include inserting the prongs of the paper prong fastener through the weld pins 506 breaking away respective portions of the fixed release liners 502 enclosed within the perforated areas 507 in some embodiments, wicket holes 508 in the fixed release liners 502, which will be generally aligned with each other, are then utilized for mounting the multiple ones of the fixed release liners 502 to an external surface. For example, pins or tacks are passed through and inserted into the wicket holes 508 for mounting the multiple ones of the fixed release liners 502 to a wall, a table, or some other suitable type of external surface to which the fixed release liners 502 may be mounted. This external surface may be the same or similar as the external surface 130.

In an alternative embodiment, the plurality of weld pins 506 and the perforated areas 507 may be replaced by openings similar to the wicket holes 508 and multiple ones of the fixed release liners 502 may be held together by inserting prongs of a paper prong fastener through the openings and folding over prongs of the paper prong fastener. In this alternative embodiment, the paper prong fastener holds together multiple ones of the fixed release liners 502 of the fixed release liner structure.

Unlike the embodiment of the stacked packaging system 400 as shown in FIG. 5 in which the flaps 404 are coupled to the mailer packages 406 by the primary adhesive layers 409, the fixed release liners 502 are physically coupled to the closure flap 408 by tear away portions 510 between ones of perforations 512 in the fixed release liners 502. In other words, the primary adhesive layer 409 on the inner surface 416 of the closure flap 408 is exposed such that the primary adhesive layer 409 is not covered by a flap of one of the fixed release liners 502, which is unlike as discussed earlier herein with respect to FIG. 5. After the fixed release liners 502 are coupled to the external surface utilizing the openings 508, the mailer packages 406 may be removed from the fixed release liners 502 in succession. For example, a packaging employee may pull on one of the mailer packages 406 causing the tear away portions 510 between the perforations 512 to tear or rip resulting in the decoupling and removal of the mailer package 406 from the corresponding one of the fixed release liners 502. This tear away process may be performed over and over again in succession until all of the respective mailer packages 406 are removed by the packaging employee from each one of the corresponding fixed release liners 502. Once all of the mailer packages 406 are removed from the fixed release liners 502, the fixed release liners 502 may be disposed of together as the fixed release liners 502 remain coupled together even after the mailer packages 406 have been removed from the fixed release liners 502. The fixed release liners 502 remaining coupled together when disposed or thrown out results in the coupled together fixed release liners being heavier than if the fixed release liners were thrown out individually and loosely. The heaviness of the fixed release liners 502 remaining coupled together when disposed reduces the likelihood of or prevents the fixed release liners entering the environment as pollution.

In an alternative embodiment similar to the embodiment as shown in FIG. 6, the tear away portions 510 and the header perforations 512 may be replaced with a respective flap of the fixed release liner 502 that is coupled to the mailer package 406 by an adhesive layer. This would be similar to the flap 404 of the fixed release liner 402 being coupled to the closure flap 408 by the adhesive layer 409 as shown in embodiment of the stacked packaging system 400 as shown in FIG. 5.

Figure 7:
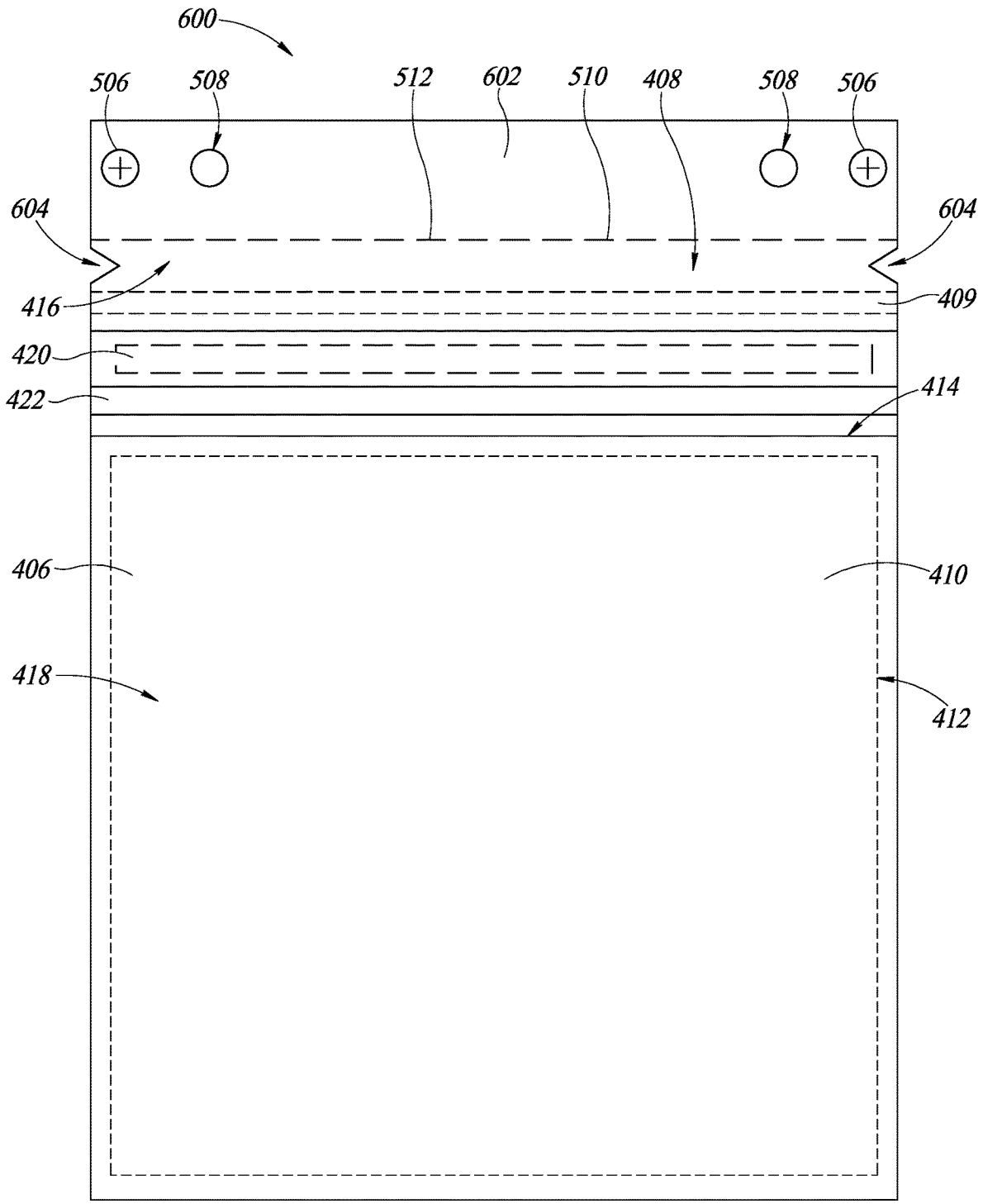
FIG. 7 is a front view of an alternative embodiment of a stacked packaging system including fixed release liners coupled to mailer packages of the present disclosure.

FIG. 7 is a front view of an alternative embodiment of a stacked packaging system 600 including fixed release liners 602 that are each coupled to a corresponding one of the mailer packages 406. Unlike the embodiment as shown in FIG. 6 in which the weld pins 506 are spaced inwardly from the wicket holes 508, the weld pins 506 as shown in FIG. 7 are spaced outwardly from the wicket holes 508. The weld pins 506 may be at locations at which multiple ones of the fixed release liners 602 are coupled (e.g., by prongs of a paper prong fastener) or welded (e.g., laser, heat, etc.) together such that there is a fixed release liner structure that includes a stack of fixed release liners 602. Each one of the fixed release liners 602 of the fixed release liner structure may each be coupled to a corresponding mailer package in a stack of the mailer packages 406 that are stacked on each other, respectively. These additional ones of the fixed release liners 602 and the mailer packages 406 in these stacks may be behind the fixed release liner 602 and the mailer package 406 as shown in FIG. 7. Positioning the weld pins 506 to be spaced outwardly from the wicket holes 508 may reduce stresses on the fixed release liners 602 and the mailer packages 406 to avoid tearing the fixed release liners 602 or tearing the mailer packages 406 in an unexpected fashion that damages the mailer packages 406 when removing one of the mailer packages 406 from the fixed release liners 602.

Unlike the embodiment as shown in FIG. 6, the alternative embodiment as shown in FIG. 7 includes a pair of opposing punch openings 604 that extend through one or more of the fixed release liners 602. The opposing punch openings 604 may reduce the likelihood of tearing of the fixed release liner 602 and the mailer package 406 when removing the mailer package 406 from the fixed release liner 602. In other words, the opposing punch openings 604 may disperse stress and strain at these locations to reduce the likelihood or prevent tearing of the fixed release liner 602 or the mailer package 406 when removing the mailer package 406 from the fixed release liner 602.

The punch openings 604 may be formed when manufacturing the stacked packaging system 600 as shown in FIG. 7 including the mailer packages 406 and the fixed release liners 602 as shown in FIG. 7. The punch openings 604 are adjacent to opposing ends of the header perforations 512 (see FIG. 7) to avoid heat seal beads forming along edges of the fixed release liners 602 and the mailer packages 406 at locations corresponding to the punch openings 604 when forming the stacked packaging system 600. The tear away portions 510 are between the header perforations 512.

Without the punch openings 604 at the locations as shown in FIG. 7, heat seal beads may be formed at these locations corresponding to the punch openings 604 that weld ones of the fixed release liners 602 to ones of the mailer packages 406 when forming the stacked packaging system 600. For example, as the mailer package 406 and the fixed release liner 602 or stacks of mailer packages 406 and stacks of fixed release liners 602 are cut to form the stacked packaging system 600, the punch openings 604 are formed such that when a blade cuts the mailer package 406 and the fixed release liner 602 or cuts stacks of the mailer packages 406 and stacks of the fixed release liners 602 to form the stacked packaging system 600, the punch openings 604 reduce the likelihood or prevent the fixed release liner or liners 602 from being partially or fully welded to the mailer package or packages 406 by preventing the formation of heat seal beads at these locations corresponding to the punch openings 604. For example, if one of the fixed release liners 602 is fully or partially welded to a corresponding one of the mailer packages 406 by the formation of these heat-sealed beads, the corresponding one of the mailer packages 406 or the one of the fixed release liners 602 may tear in an unexpected fashion when removing the corresponding one of the mailer package 406 from the one of the fixed releaser liners 602. This unexpected tearing may damage the mailer package 406 rendering the mailer package 406 unusable for shipping a product or item to a customer. In other words, the punch openings 604 reduce the likelihood or prevent formation of these heat-sealed beads at the locations at which the punch openings 604 are present when forming the stacked packaging system 600. The punch openings 604 may be formed before the mailer package 406 and the fixed release liner 602 or the stack of mailer packages 406 and the stack of the fixed release liners 602 are cut by the blade or some other suitable singulation tool to form multiple ones of the stacked packaging systems 600 or individual ones of the mailer packages 406 and the fixed release liners 602 that may then be utilized to form the stacked packaging system 600.

As shown in FIG. 7, the punch openings 604 are triangular shaped. However, in some alternative embodiments, the punch openings 604 may be semi-circular (e.g., half-circles) or some other shape that is selected to reduce the likelihood or prevent tearing of the fixed release liner 602 or the mailer package 406 when removing the mailer package 406 from the fixed release liner 602. In some alternative embodiments, the punch openings 604 may be semi-circular (e.g., half-circles) or some other shape that is selected to reduce the likelihood or prevent the formation of the heat seal beads at the locations at which the punch openings 604 are present as shown in FIG. 7. When the stacked packaging system 600 as shown in FIG. 7 includes a stack of fixed release liners 602 and a stack of mailer packages 406, the punch openings 604 may extend through each one of the stacked fixed release liners 602 and may extend through each one of the stacked mailer packages 406 at the locations at which the punch openings 605 are located, respectively.

The fixed release liner 602 as shown and visible in FIG. 7 overlaps the primary adhesive layer 409 on the closure flap 408 of the mailer package or bag 406. In some embodiments (see FIGS. 1A and 1B), the fixed release liner 602 is coupled to the closure flap 408 by the closure adhesive such that the fixed release liner 602 is removable from the closure flap 408 of the mailer package 406. Alternatively, in the embodiment as shown in FIG. 7, the fixed release liner 602 is physically coupled to the closure flap 408 by the tear away portions 510 between the header perforations 512, respectively. When the closure flap 408 of the mailer package 406 is decoupled from the fixed release liner 602 by a user such as by pulling on the mailer package 406, the tear away portions 510 coupling the closure flap of the mailer package 406 to the fixed release liner 602 between the header perforations 512 are torn. The primary adhesive layer 409 on the closure flap 408 remains with the closure flap 408 when removing the mailer package 406 from the fixed release liner 602 by tearing the tear away portions 510. The primary adhesive layer 409 may already be exposed at the time of removing the mailer package 406 from the fixed release liner 602. After the mailer package 406 has been removed from the fixed release liner 602, the primary adhesive layer 409 remains present on the closure flap 408 of the mailer package 406 and is exposed. For example, the primary adhesive layer 409 remains on the inner surface 416 of the closure flap 408 after the mailer package 406 has been removed from the fixed release liner 602. The closure flap 408 is then folded over to seal the closure flap 408 to outer or exterior surface 418 of the mailer package 406 to enclose a product or item to be shipped to a consumer within the cavity 412 within package portion 410 of the mailer package 406. The product or item may have been placed into the cavity 412 of the mailer package 406 through the mailer package/bag opening 414 before the mailer package 406 is decoupled from the fixed release liner 602 or after the mailer package 406 is decoupled from the fixed release liner 602.

The mailer package 406 enclosing the product or item may be shipped to the customer, consumer, purchaser, etc. To access the product or item enclosed within the mailer package 406, the customer tears the closure flap 408 along the tear strip 420 to expose the cavity 412 of the mailer package 406 and access the product within the cavity 412 of the mailer package 406. If the customer decides to return the product, the customer may remove the secondary liner 422 (e.g., an adhesive cover such as a strip of material that may include a plastic, a metallized material, or some other polymer material or suitable material to cover the adhesive) to expose an optional release liner adhesive. The secondary liner 422 may be referred to as a liner layer that covers the optional release liner adhesive. The customer may then adhere a portion of the mailer package 406 on which the optional release liner adhesive is present and exposed by removing the secondary liner 422 to enclose the product or item to be returned within the mailer package 406. Once the product is enclosed within the cavity 412 of the mailer package 406, the consumer may then return the product or item to the seller by dispensing the packed mailer package at a mailing outlet.

In an alternative embodiment similar to the embodiment as shown in FIG. 7, the tear away portions 510 and the header perforations 512 may be replaced with a respective flap of the fixed release liner 602 that is coupled to the mailer package 406 by an adhesive layer. This would be similar to the flap 404 of the fixed release liner 402 being coupled to the closure flap 408 by the adhesive layer 409 as shown in embodiment of the stacked packaging system 400 as shown in FIG. 5.

The above discussed respective embodiments of the stacked packaging systems 100, 200, 300, 400, 500, 600, which may be referred to as mailer package assemblies, as shown in FIGS. 1A, 1B, 2A-2F, 3A-3D, 4A-4D, 5, 6, and 7 may be made of poly-plastic materials or may be made of other materials such as paper based materials. These poly-plastic materials may be high density polyethylene (HDPE) materials, low density polyethylene (LDPE) materials, polyethylene terephthalate (PET, PETE) materials, polypropylene (PP) materials, polystyrene materials, polyvinyl chloride (PVC, vinyl) materials, or some other or similar type of poly-plastic material that may be utilized for the mailer package assemblies. These paper based materials may be plant based materials such as cotton, whet straw, flax, bamboo, wood, linen, hemp, or some other or similar type of plant based material that may be utilized for the mailer package assemblies. In some embodiments, the mailer package assemblies as shown in FIGS. 5 and 6 may be a combination of poly-plastic material, paper materials, or some other or similar types of materials.

The multiple fixed release liners of the embodiments of the stacked packaging system 100, 200, 300, 400, 500, 600 that are coupled together in these various embodiments of the present disclosure may be referred to as fixed release liner structures, a fixed release liner header, a fixed releaser liner header structure, or some other suitable reference to multiple ones of the fixed releaser liners coupled together. For example, these various embodiments of the fixed release liner structures each include a plurality of the fixed release liners that are coupled together such that multiple ones of the fixed release liners and the mailer packages of the present disclosure are in a stacked configuration when mounted to an external surface.

A device of the present disclosure may be summarized as including: a mailer package including a closure flap, the closure flap including: an inner surface; an upper end; a first adhesive layer on the inner surface; a second adhesive layer on the inner surface, the second adhesive layer is further away from the upper end than the first adhesive layer; a second liner on the second adhesive layer, the second liner covers the second adhesive layer; a tear strip between the first adhesive layer and the second adhesive layer; a fixed release liner removably coupled to the closure flap of the mailer package by the first adhesive layer, the fixed release liner including one or more openings extending through the fixed release liner.

The fixed release liner may further include a first edge and a second edge opposite to the first edge; the one or more openings may include a pair of wicket holes that extend through the fixed release liner; and the fixed release liner may include a pair of weld pins.

The pair of wicket holes may be spaced outwardly from the pair of weld pins, and the pair of wicket holes may be closer to the first edge and the second edge than the pair of weld pins.

The pair of weld pins may be spaced outwardly from the pair of wicket holes, and the pair of weld pins may be closer to the first edge and the second edge than the pair of wicket holes.

A device of the present disclosure may be summarized as including: a plurality of mailer packages, each one of the plurality of mailer packages includes a closure flap; a plurality of adhesive layers, each one of the plurality of adhesive layers on a corresponding one of the closure flaps of the plurality of mailer packages; and a plurality of fixed release liners, each one of the fixed release liners detachably coupled to a corresponding one of the closure flaps of the plurality of mailer packages by a corresponding one of the adhesive layers.

A method or the present disclosure may be summarized as including: mounting a fixed release liner to an external surface; decoupling a fixed release liner from a closure flap of a mailer package by pulling on the mailer package; placing an item within a cavity of the mailer package through an opening in the mailer package; and sealing the opening of the mailer package by contacting an adhesive layer on an inner surface of the closure flap to an outer surface of the mailer package.

A device of the present disclosure may be summarized as including: a plurality of mailer packages, each one of the plurality of mailer packages includes a closure flap; a plurality of adhesive layers, each one of the plurality of adhesive layers on a corresponding one of the closure flaps of the plurality of mailer packages; and a plurality of fixed release liners, each one of the fixed release liners detachably coupled to a corresponding one of the closure flaps of the plurality of mailer packages.

Each one of the fixed release liners of the plurality of fixed release liners may be detachably coupled to a corresponding one of the closure flaps of the plurality of mailer packages by a corresponding one of the adhesive layers.

Each one of the fixed release liners of the plurality of fixed release liners may include a plurality of perforations between the corresponding one of the fixed release liners and the corresponding one of the closure flaps of the plurality of mailer packages.

Each one of the fixed release liners of the plurality of fixed release liners may include a plurality of tear away portions between adjacent ones of the plurality of perforations that couple the corresponding one of the fixed release liners to the corresponding one of the plurality of mailer packages, and the plurality of tear away portions are configured to be torn when removing the corresponding one of the plurality of mailer packages from the corresponding one of the fixed release liners.

The device may further include a fixed release liner structure including each one of the plurality of fixed release liners in which each one of the plurality of fixed release liners are coupled together.

The fixed release liner structure may be configured to be disposed as a single unit after the plurality of mailer packages have been removed from the plurality of fixed release liners of the fixed release liner structure.

U.S. Provisional Patent Application No. 63/240,336, filed on Sep. 2, 2021, and U.S. Provisional Patent Application No. 63/319,740, filed on Mar. 14, 2022, are incorporated herein by reference, in their entirety.

The various embodiments described above can be combined to provide further embodiments. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A device, comprising:

a plurality of stacked mailer packages, each of the stacked mailer packages including:

a closure flap; and an adhesive layer adhered to the closure flap; and a plurality of stacked release liners, wherein the stacked release liners are fixedly coupled to one another in a stacked configuration, and the stacked release liners remain in a stacked configuration even when ones of the plurality of stacked mailer packages are and have been removed from ones of the plurality of stacked release liners; and wherein, in a first configuration, in which the mailer packages are open, each of the release liners is detachably coupled to the closure flap of one of the mailer packages by the adhesive layer adhered to the closure flap and, in a second configuration, in which one of the mailer packages is closed, the closure flap of the closed mailer package is coupled to a surface of the closed mailer package by the adhesive layer.

2. A method, comprising:

stationarily mounting a stack of mailer packages to a surface, the stack including a plurality of stacked release liners fixedly coupled to each other and a plurality of mailer packages, each of the mailer packages of the plurality of mailer packages has a respective closure flap adhered to a corresponding release liner of the plurality of stacked release liners by a corresponding adhesive layer;

decoupling a first mailer package of the plurality of mailer packages from a first release liner of the plurality of stacked release liners, including the respective closure flap of the first mailer package and the corresponding adhesive layer, from the corresponding release liner of the plurality of stacked release liners, by pulling the first mailer package away from the first release liner, thereby decoupling the respective closure flap of the first mailer package and the corresponding adhesive layer from the first release liner and leaving the first release liner coupled to the rest of the plurality of stacked release liners;

placing an item within a cavity of the first mailer package through an opening in the first mailer package; and sealing the opening of the first mailer package by contacting the adhesive layer to a surface of the first mailer package.

3. The device of claim 1, wherein each of the respective release liners of the plurality of stacked release liners includes:

a first edge;

a second edge opposite to the first edge; and a pair of wicket holes that extend through the release liner.

4. The device of claim 3, wherein each of the respective release liners of the plurality of stacked release liners further includes a pair of weld pins, and the pair of wicket holes are spaced outwardly from the pair of weld pins, and the pair of wicket holes are closer to the first edge and the second edge than the pair of weld pins.

5. The device of claim 3, wherein each of the respective release liners of the plurality of stacked release liners further includes a pair of weld pins, and the pair of weld pins are spaced outwardly from the pair of wicket holes, and the pair of weld pins are closer to the first edge and the second edge than the pair of wicket holes.

6. The device of claim 1, further comprising a plurality of perforations between each of the respective release liners of the plurality of stacked release liners and the corresponding closure flaps of the plurality of stacked mailer packages.

7. The device of claim 6, further comprising tear away portions between the perforations, wherein the tear away portions are configured to be torn when removing the respective mailer packages of the plurality of stacked mailer packages from the respective release liners of the plurality of stacked release liners.

8. The device of claim 1, further comprising:

a supplementary adhesive layer adhered to the closure flap, the supplementary adhesive layer further away from a terminal end of the closure flap than the adhesive layer; and a supplementary release liner covering the supplementary adhesive layer.

9. The device of claim 8, wherein:

the supplementary release liner is configured to, in operation, be removed by a consumer, thereby exposing the supplementary adhesive layer after the mailer package has been opened by the consumer; and the supplementary adhesive layer is configured to, in operation, seal the mailer package closed after being opened by the consumer to return a product to a seller.

10. The device of claim 8, further comprising a tear strip between the adhesive layer and the supplementary adhesive layer, wherein the tear strip is configured to, in operation, be torn by a consumer to access a product within the mailer package.

* * * * *